US009181516B2

(12) United States Patent
Barthel et al.

(10) Patent No.: US 9,181,516 B2
(45) Date of Patent: Nov. 10, 2015

(54) FRAGRANT MEDIUM DISPENSING SYSTEM

(75) Inventors: Wolfgang Barthel, Langenfeld (DE); Rene-Andres Artiga Gonzalez, Duesseldorf (DE); Georg Meine, Mettmann (DE); Salvatore Fileccia, Oberhausen (DE)

(73) Assignee: Henkel AG & Co. KGAA, Duesseldorf (DE)

( * ) Notice: Subject to any disclaimer, the term of this patent is extended or adjusted under 35 U.S.C. 154(b) by 809 days.

(21) Appl. No.: 12/417,178

(22) Filed: Apr. 2, 2009

(65) Prior Publication Data

US 2009/0247446 A1 Oct. 1, 2009

Related U.S. Application Data

(63) Continuation of application No. PCT/EP2007/059635, filed on Sep. 13, 2007.

(30) Foreign Application Priority Data

Oct. 4, 2006 (DE) ..... 10 2006 047 230

(51) Int. Cl.
*C11D 3/50* (2006.01)
*C11D 17/04* (2006.01)

(52) U.S. Cl.
CPC ..... *C11D 3/505* (2013.01); *C11D 17/042* (2013.01)

(58) Field of Classification Search
CPC ..... C11D 3/505; C11D 17/042
USPC ..... 510/441, 104; 512/1; 424/401
See application file for complete search history.

(56) References Cited

U.S. PATENT DOCUMENTS

| | | | | |
|---|---|---|---|---|
| 2002/0013251 | A1* | 1/2002 | Hayashi et al. | 510/445 |
| 2006/0123557 | A1* | 6/2006 | Caswell et al. | 8/115.51 |
| 2006/0258553 | A1* | 11/2006 | Catalfamo et al. | 510/302 |

FOREIGN PATENT DOCUMENTS

| | | | | |
|---|---|---|---|---|
| EP | 1 614 743 | A1 | 1/2006 | |
| EP | 1614743 | * | 1/2006 | C11D 3/50 |
| GB | 899100 | | 6/1962 | |
| GB | 2 432 843 | A | 6/2007 | |
| WO | WO 2004/006967 | A1 | 1/2004 | |
| WO | WO 2007/130684 | A1 | 11/2007 | |

OTHER PUBLICATIONS

Hydrolysis—Wikipedia {http://en.wikipedia.org/wiki/Hydrolysis}.*

Albert J. Leo, "Methods of Calculating Partition Coefficients," *Comprehensive Medicinal Chemistry,* Pergamon Press, vol. 4, No. 18.7, pp. 295-319.

Arnold J. Gordon et al., "Properties of Molecular Systems," *The Chemist's Companion,* John Wiley & Sons, 1972, pp. 30-36.

David T. Stanton et al., "Computer-assisted prediction of normal boiling points of furans, tetrahydrofurans, and thiophenes," *J. Chem. Inf. Comput. Sci.,* vol. 31, No. 2, 1991, pp. 301-310.

David T. Stanton et al., "Computer-assisted prediction of normal boiling points of pyrans and pyrroles,"*J. Chem. Inf. Comput. Sci.,* vol. 32, No. 4, pp. 306-316.

Ramiah Murugan et al., "Predicting physical properties from molecular structure," *Chemtech,* Jun. 1994, pp. 17-23.

International Search Report of PCT/EP2007/059635, dated Jan. 17, 2008.

* cited by examiner

*Primary Examiner* — Patrick Ryan
*Assistant Examiner* — Aaron Greso
(74) *Attorney, Agent, or Firm* — RatnerPrestia

(57) ABSTRACT

A fragrant medium dispensing system, which contains a polymer-containing, perfumed shaped article that is supplied in a withdrawal receptacle. The fragrant medium dispensing system enables fragrances to be individually dosed. The fragrant medium dispensing system can be used in the context of methods for perfuming or reinforcing the fragrance of an aqueous system.

22 Claims, No Drawings

FRAGRANT MEDIUM DISPENSING SYSTEM

This application is a continuation under 35 U.S.C. §§120 and 365(c) of International Application PCT/EP2007/059635, filed on Sep. 13, 2007. This application also claims priority under 35 U.S.C. §119 of DE 10 2006 047 230.6 filed on Oct. 4, 2006. The disclosures of PCT/EP2007/059635 and 10 2006 047 230.6 are incorporated by reference in their entirety.

BACKGROUND OF THE INVENTION

The invention relates to a fragrant medium dispensing system that includes a perfumed, polymer-containing shaped article that is supplied in a withdrawal receptacle. The invention further relates to the use of the fragrant medium dispensing system for dosing fragrances as well as a method for perfuming aqueous systems.

Odoriferous substances have long been used to produce pleasant odors and represent an important facet of human culture. For example, odoriferous substances were employed very early on for sacral or cultic purposes. An example of this is the burning of incense. In general, odoriferous substances are intended to mask other odors considered to be unpleasant or to create pleasant, appealing odors. The use of odoriferous substances often has the purpose of suggesting the impression of cleanliness.

Also, most laundry detergents and cleaning products comprise odoriferous substances. These mask the original product odor and provide for a pleasant odor sensation.

It has been shown that the consumer develops a constant need for new fragrances; consequently newly perfumed products are continually offered commercially. However, there is a certain shortcoming in that the commercially available products are very uniformly perfumed in so far as the fragrance intensity is concerned. The fragrance intensity was determined according to the requirements of an average consumer. Consequently, consumers who have a very sensitive or on the other hand have a reduced perception of fragrance suffer from the uniform product fragrance level. This concerns all products, such as laundry detergents or cleaning compositions, which are used in connection with aqueous systems.

DESCRIPTION OF THE INVENTION

With this background in mind, the object of the present invention was to provide the consumer with the possibility of perfuming aqueous systems according to individual taste. This object is achieved by the subject matter of the invention.

The subject matter of the invention is a fragrant medium dispensing system that includes a perfumed, preferably water-soluble or water-dispersible, shaped article that comprises at least 20 wt. % polymer(s) as well as at least 10 wt. % odoriferous substance, each wt. % being based on the total shaped article, wherein the shaped article is supplied in a withdrawal receptacle.

A fragrant medium is a medium that carries odoriferous substances; in the present case it concerns a perfumed shaped article. A fragrant medium dispensing system is a subject matter that enables the preferably metered or portioned dispensing of the fragrant medium, i.e. the perfumed shaped article, to the consumer.

According to a preferred embodiment, the polymer fraction of the shaped article can also be significantly higher than 20 wt. %, e.g. at a figure of at least 25 wt. %, 30 wt. %, 35 wt. %, 40 wt. %, 45 wt. %, 50 wt. %, 55 wt. %, 60 wt. %, 65 wt. %, 70 wt. % or also at least 75 wt. % or even at least 80 wt. %, wherein wt. % is based on the total shaped article. Possible upper limits for the polymer fraction of the shaped article can be at a figure of maximum 95 wt. %, 90 wt. %, 85 wt. %, 80 wt. %, 75 wt. %, 70 wt. %, 65 wt. %, 60 wt. %, 55 wt. %, 50 wt. %, 45 wt. %, 40 wt. %, 35 wt. % or maximum 30 wt. %. The polymer fraction of the shaped article can therefore be e.g. in the range 35 wt. % to 70 wt. % or e.g. in the range 40 wt. % to 80 wt. %, etc.

According to a considerably preferred embodiment, the perfumed shaped article is a strip-shaped, a sheet-shaped, a wafer-shaped or a web-shaped preferably flexible, in particular a sheet or a film.

A sheet or a film is a thin, flat material. Films are generally more or less flexible, their flexibility being dependent on both the thickness of the film web as well as on the nature of the raw material. For very stiff products, one no longer speaks in general terms of films but rather of plaques. Plaques are also included according to the invention. The thicknesses of the films can preferably be between about 1 and 500 μm. Even thinner films are also possible, which are then designated as membranes. These are also included by the invention. Even thicker films with a thickness>500 μm are also possible. These are also included by the invention. Preferred film thicknesses are <400 μm, <300 μm, <200 μm or also less than <100 μm. Thicknesses of e.g. <80 μm, <60 μm or <40 μm are also possible.

Possible minimum thicknesses can be for example 2, 3, 4, 5, 6, 7, 8, 9 or 10 μm. Minimum thicknesses of e.g. 15, 20, 25, 30, 35, 40, 45 or 50 μm are also possible, even values of at least 60, 70, 80, 90, 100, 150 or 200 μm are possible.

An inventive film can therefore have a thickness of 3 to <200 μm or e.g. 20 to <80 μm, in order to cite only 2 examples.

The length to width dimensions of a preferred strip-shaped, sheet-shaped, wafer-shaped or web-shaped article, such as especially sheet or film can be (independently of one another):

(a) in length, preferably 1 cm to 30 cm, advantageously 2 cm to 20 cm, more advantageously 3 cm to 15 cm, especially 4 cm to 10 cm, (b) in width, preferably 1 cm to 25 cm, advantageously 2 cm to 20 cm, more advantageously 3 cm to 15 cm, especially 4 cm to 10 cm.

The minimum length of the film can also be 5, 6, 7 or 8 cm. The minimum width of the film can likewise be 5, 6, 7 or 8 cm.

An inventive film can have any shape, for example square, rectangular, triangular, oval or circular. Special shapes are also possible, for example heart shaped, in the form of numbers or letters.

The inventive shaped articles, preferably films, can be transparent or opaque. They can be single-ply or multi-ply films.

Whereas multi-ply films, e.g. PA/PE films, have a plurality of various materials, e.g. a PA and a PE layer, single-ply films consist of only one individual film material, that of course can include a mixture of different materials, especially a polymer blend. Both single-ply and multi-ply films are included by the invention.

When films consist of two layers of the same material, they are called double films. An important reason for manufacturing double films can be the production of greater film thicknesses. A variant of this is the coextrusion of two layers of a thermoplastic as the alternative to a single thicker layer. Double films are also included by the invention.

According to a preferred embodiment of the invention, the inventive films are multi-ply.

The inventive shaped articles can comprise a single polymer or a blend of various polymers. In preferred cases, the shaped article comprises one or more materials from the group (optionally acetalized) polyvinyl alcohol (PVAL) and/or PVAL copolymers, polyvinyl pyrrolidone, polyethylene oxide, polyethylene glycol, gelatine, cellulose and its derivatives, particularly MC, HEC, HPC, HPMC and/or copolymers as well as their mixtures. Optionally, well known plasticizers can be blended into the shaped article in order to increase the flexibility of the material, or other auxiliaries or additives can be incorporated.

In the context of the present invention, polyvinyl alcohols are particularly preferred water-soluble polymers. "Polyvinyl alcohols" (abbreviation PVAL, sometimes also PVOH) is the term for polymers with the general structure

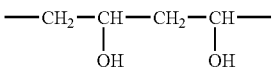

which comprise lesser amounts (ca. 2%) of structural units of the type

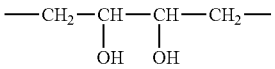

Typical commercial polyvinyl alcohols, which are offered as yellowish white powders or granules having degrees of polymerization in the range of approx. 100 to 2500 (molar masses of approximately 4000 to 100 000 g/mol), have degrees of hydrolysis of 98-99 or 87-89 molar % and thus still have a residual acetyl group content. The manufacturers characterize the polyvinyl alcohols by stating the degree of polymerization of the initial polymer, the degree of hydrolysis, the saponification number and/or the solution viscosity.

The solubility in water and in a few strongly polar organic solvents (formamide, dimethylformamide, dimethyl sulfoxide) of polyvinyl alcohols is a function of the degree of hydrolysis; they are not attacked by (chlorinated) hydrocarbons, esters, fats or oils. Polyvinyl alcohols are classified as toxicologically inoffensive and are at least partially biologically degradable. The solubility in water can be reduced by post-treatment with aldehydes (acetalization), by complexing with Ni salts or Cu salts or by treatment with dichromates, boric acid or borax. Polyvinyl alcohol is substantially impermeable to gases such as oxygen, nitrogen, helium, hydrogen, carbon dioxide, but does allow water vapor to pass through.

Preferred shaped articles in the context of the present invention are characterized in that they comprise polyvinyl alcohols and/or PVAL copolymers whose degree of hydrolysis is from 70 to 100 molar %, preferably from 80 to 90 molar %, with particular preference from 81 to 89 molar %, and in particular from 82 to 88 molar %.

Preferably, polyvinyl alcohols of a defined molecular weight range are used, wherein preferred methods according to the invention are those where the shaped article comprises polyvinyl alcohols and/or PVAL copolymers whose molecular weight lies in the range 3500 to 100 000 $gmol^{-1}$, preferably from 10 000 $gmol^{-1}$ to 90 000 $gmol^{-1}$, with particular preference from 12 000 to 80 000 $gmol^{-1}$, and in particular from 13 000 to 70 000 $gmol^{-1}$.

The degree of polymerization of such preferred polyvinyl alcohols lies between approximately 200 and approximately 2100, preferably between approximately 220 and approximately 1890, with particular preference between approximately 240 and approximately 1680, and in particular between approximately 260 and approximately 1500.

According to the invention, preferred shaped articles are those wherein the shaped article comprises polyvinyl alcohols and/or PVAL copolymers whose average degree of polymerization lies between 80 and 700, preferably between 150 and 400, particularly preferably between 180 and 300 and/or whose molecular weight ratio MG(50%) to MG(90%) lies between 0.3 and 1, preferably between 0.4 and 0.8 and particularly between 0.45 and 0.6.

The above described polyvinyl alcohols are widely commercially available, for example under the trade name Mowiol® (Clariant). Examples of polyvinyl alcohols which are particularly suitable in the context of the present invention are Mowiol® 3-83, Mowiol® 4-88, Mowiol® 5-88, and Mowiol® 8-88.

Further polyvinyl alcohols that are particularly suitable as the material for the shaped article are to be found in the following table:

| Name | Hydrolysis Degree [%] | Mol wt [kDa] | Melting point [° C.] |
|---|---|---|---|
| Airvol ® 205 | 88 | 15-27 | 230 |
| Vinex ® 2019 | 88 | 15-27 | 170 |
| Vinex ® 2144 | 88 | 44-65 | 205 |
| Vinex ® 1025 | 99 | 15-27 | 170 |
| Vinex ® 2025 | 88 | 25-45 | 192 |
| Gohsefimer ® 5407 | 30-28 | 23.600 | 100 |
| Gohsefimer ® LL02 | 41-51 | 17.700 | 100 |

Further polyvinyl alcohols that are suitable as materials for the shaped article are ELVANOL® 51-05, 52-22, 50-42, 85-82, 75-15, T-25, T-66, 90-50, (trade marks of Du Pont), ALCOTEX® 72.5, 78, B72, F80/40, F88/4, F88/26, F88/40, F88/47, (trade marks of Harlow Chemical Co.), Gohsenol® NK-05, A-300, AH-22, C-500, GH-20, GL-03, GM-14L, KA-20, KA-500, KH-20, KP-06, N-300, NH-26, NM11Q, KZ-06 (trade marks of Nippon Gohsei K. K.). ERKOL types from Wacker are also suitable.

Another preferred group of water-soluble polymers that can be inventively comprised in the shaped articles are the polyvinyl pyrrolidones. These are marketed, for example, under the designation Luviskol® (BASF). Polyvinyl pyrrolidones [poly(1-vinyl-2-pyrrolidinones)], abbreviated PVP, are polymers of the general Formula (I)

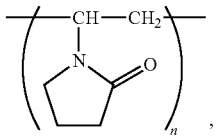

(I)

prepared by free-radical polymerization of 1-vinyl pyrrolidone by solution or suspension polymerization processes using free-radical initiators (peroxides, azo compounds). The ionic polymerization of the monomer yields only products with low molecular weights. Commercial polyvinyl pyrrolidones have molecular weights in the range ca. 2500-750 000 g/mol, characterized by their K-values and depending on the K-value have glass transition temperatures from 130-175°. They are offered as a white, hygroscopic powder or as aqueous solutions. Polyvinyl pyrrolidones are highly soluble in water and a great number of organic solvents (inter alia alcohols, ketones, glacial acetic acid, chlorinated hydrocarbons, phenols).

Copolymers of vinyl pyrrolidone with other monomers are also suitable, in particular vinyl pyrrolidone/vinyl ester copolymers, such as for example those commercialised under the trade name Luviskol® (BASF). Luviskol® VA 64 and Luviskol® VA 73, each vinyl pyrrolidone-vinyl acetate copolymers, are likewise preferred non-ionic polymers.

The vinyl ester polymers are polymers obtainable from vinyl esters with the groups of Formula (II)

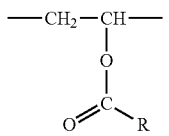

(II)

as the characteristic basic structural unit of the macromolecules. Of these, the vinyl acetate polymers ($R{=}CH_3$) with polyvinyl acetates, are by far the most important representatives and have the greatest industrial significance. Polymerization of vinyl esters occurs radically according to different processes (solution polymerization, suspension polymerization, emulsion polymerization, substance polymerization). Copolymers of vinyl acetate with vinyl pyrrolidone comprise monomer units of Formula (I) and (II).

Other suitable water-soluble polymers are the polyethylene glycols (polyethylene oxides) that have the abbreviation PEG. PEG are polymers of ethylene glycol that satisfy the general Formula (III)

$$H{-}(O{-}CH_2{-}CH_2)_n{-}OH \quad (III)$$

wherein n can take values between 5 and >100 000.

PEGs are industrially manufactured mainly by the anionic ring opening polymerization of ethylene oxide (oxirane) in the presence of small amounts of water. Depending on the reaction conditions, they have molecular weights in the range ca. 200-5 000 000 g/mol, corresponding to polymerization degrees of ca. 5 to >100 000.

Products with molecular weights<about 25 000 g/mol are liquids at room temperature and are described as true polyethylene glycols, abbreviation PEG. These short-chain PEGs can be added, especially as plasticizers, to other water-soluble polymers e.g. polyvinyl alcohols or cellulose ethers. The polyethylene glycols, which are solid at room temperature and used according to the invention, are described as polyethylene oxides, abbreviation PEOX. High molecular weight polyethylene oxides possess an extremely low concentration of reactive hydroxyl end groups and therefore show only slight properties of glycols.

According to the invention, another further suitable material for the shaped articles is gelatine, this being preferably used together with other polymers. Gelatine is a polypeptide (molecular weight: approx. 15 000 to >250 000 g/mol) obtained principally by hydrolysis under acidic or alkaline conditions of the collagen present in the skin and bones of animals. The amino acid composition of gelatine corresponds largely to that of the collagen from which it was obtained, and varies as a function of its provenance. The use of gelatine as a water-soluble coating material is extremely widespread, especially in pharmacy, in the form of hard or soft gelatine capsules. Gelatine in the form of films finds only limited use, due to its high price compared with the above cited polymers.

Further suitable water-soluble polymers according to the invention are described below:

Cellulose ethers, such as hydroxypropyl cellulose, hydroxyethyl cellulose, and methyl hydroxypropyl cellulose, as marketed for example under the trademarks Culminal® and Benecel® (AQUALON).

Cellulose ethers can be described by means of the general Formula (IV):

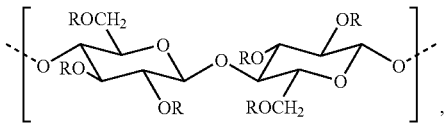

(IV)

in which R stands for H or an alkyl, alkenyl, alkynyl, aryl or alkylaryl group. In preferred products, at least one R stands for $—CH_2CH_2CH_2—OH$ or $—CH_2CH_2—OH$ in the Formula (III). Cellulose ethers are prepared industrially by etherifying alkali cellulose (e.g., with ethylene oxide). Cellulose ethers are characterized by way of the average degree of substitution, DS, and/or by the molar degree of substitution, MS, which indicate how many hydroxyl groups of an anhydroglucose unit of cellulose have reacted with the etherifying reagent or how many moles of the etherifying reagent have been added on, on average, to one anhydroglucose unit. Hydroxyethyl celluloses are water-soluble above a DS of approximately 0.6 and an MS of approximately 1. Typical commercial hydroxyethyl- and hydroxypropyl celluloses have degrees of substitution in the range of 0.85-1.35 (DS) and 1.5-3 (MS), respectively. Hydroxyethyl and hydroxypropyl celluloses are marketed as yellow-white, odorless and tasteless powders with vastly different degrees of polymerization. Hydroxyethyl and hydroxypropyl celluloses are soluble in cold and hot water and in some (water-containing) organic solvents, but insoluble in the majority of (anhydrous) organic solvents; their aqueous solutions are relatively insensitive to changes in pH or addition of electrolyte.

Preferred shaped articles according to the invention are characterized in that they comprise hydroxypropyl methyl cellulose (HPMC), which has a degree of substitution (average number of methoxy groups per anhydroglucose unit of the cellulose) from 1.0 to 2.0, preferably from 1.4 to 1.9, and a molar substitution (average number of hydroxypropyl groups per anhydroglucose unit of the cellulose) from 0.1 to 0.3, preferably from 0.15 to 0.25.

Further suitable polymers according to the invention are water-soluble amphopolymers. The generic term amphopolymers embraces amphoteric polymers, i.e., polymers whose molecule includes both free amino groups and free —COOH or $—SO_3H$ groups and are capable of forming inner salts; zwitterionic polymers whose molecule contains quaternary ammonium groups and $—COO^-$ or $—SO_3^-$ groups, and polymers containing —COOH or $—SO_3H$ groups and quaternary ammonium groups. An example of an amphopolymer which may be used in accordance with the invention is the acrylic resin obtainable under the designation Amphomer®, which constitutes a copolymer of tert-butylaminoethyl methacrylate, N-(1,1,3,3-tetramethylbutyl)acrylamide, and two or more monomers from the group consisting of acrylic acid, methacrylic acid and their simple esters. Similarly preferred amphopolymers are composed of unsaturated carboxylic acids (e.g. acrylic and methacrylic acid), cationically derivatized unsaturated carboxylic acids (e.g. acrylamidopropyltrimethylammonium chloride) and optionally additional ionic or non-ionic monomers. According to the invention, particularly preferred amphopolymers are terpolymers of acrylic acid, methyl acrylate and methacrylamidopropyltrimonium chloride, as are commercially available under the name Merquat®2001 N. Further suitable amphoteric polymers are, for example, the octylacrylamide methyl methacrylate tert-butylaminoethyl methacrylate 2-hydroxypropyl methacrylate copolymers available under the designations Amphomer® and Amphomer® LV-71 (DELFT NATIONAL).

Suitable water-soluble anionic polymers according to the invention are inter alia:

vinyl acetate-crotonic acid copolymers, such as, for example, are commercialized under the designations Resyn® (National Starch), Luviset™ (BASF) and Gafset® (GAF).

In addition to monomer units of the abovementioned formula (II), these polymers also have monomer units of the general formula (V):

$$[—CH(CH_3)—CH(COOH)—]_n \quad (V)$$

vinyl pyrrolidone-vinyl acrylate copolymers, available for example from BASF under the trade name Luviflex®. A preferred polymer is the vinyl pyrrolidone/acrylate terpolymer obtainable under the name of Luviflex® VBM-35 (BASF).

Acrylic acid-ethyl acrylate-N-tert.butylacrylamide terpolymers, which are marketed for example under the designation Ultrahold® strong (BASF).

Grafted polymers of vinyl esters, esters of acrylic acid or methacrylic acid alone or in mixtures, copolymerized with crotonic acid, acrylic acid or methacrylic acid with polyalkylene oxides and/or polyalkylene glycols.

Such grafted polymers of vinyl esters, esters of acrylic acid or methacrylic acid alone or in mixtures with other copolymerizable compounds on polyalkylene glycols are obtained by polymerization under heating in the homogeneous phase by stirring in the polyalkylene glycols into the monomers of the vinyl ester, ester of acrylic acid or methacrylic acid in the presence of radical formers. Vinyl esters which have been found suitable are, for example, vinyl acetate, vinyl propionate, vinyl butyrate, vinyl benzoate, and those esters of acrylic acid or methacrylic acid obtainable from low molecular weight aliphatic alcohols, i.e., in particular, ethanol, propanol, isopropanol, 1-butanol, 2-butanol, 2-methyl-1-propanol, 2-methyl-2-propanol, 1-pentanol, 2-pentanol, 3-pentanol, 2,2-dimethyl-1-propanol, 3-methyl-1-butanol; 3-methyl-2-butanol, 2-methyl-2-butanol, 2-methyl-1-butanol, 1-hexanol.

Polypropylene glycols (abb. PPG) are polymers of propylene glycol which correspond to general formula (VI)

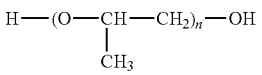

(VI)

wherein n can assume values between 1 (propylene glycol) and several thousand. In this case the industrially significant representatives are, in particular, di-, tri- and tetrapropylene glycol, i.e. the representatives where n=2, 3 and 4 in Formula (VI). In particular, vinyl acetate copolymers grafted onto polyethylene glycols and the polymers of vinyl acetate and crotonic acid grafted onto polyethylene glycols can be used.

grafted and crosslinked copolymers from the copolymerization of i) at least one monomer of the non-ionic type, ii) at least one monomer of the ionic type, iii) polyethylene glycol, and iv) a crosslinker The polyethylene glycol used has a molecular weight of between 200 and several million, preferably between 300 and 30 000.

The non-ionic monomers can be of very different types, of which the following are preferred: vinyl acetate, vinyl stearate, vinyl laurate, vinyl propionate, allyl stearate, allyl laurate, diethyl maleate, allyl acetate, methyl methacrylate, cetyl vinyl ether, stearyl vinyl ether and 1-hexene.

The non-ionic monomers may equally be of very different types, among which particular preference is given to the presence in the graft polymers of crotonic acid, allyloxyacetic acid, vinylacetic acid, maleic acid, acrylic acid, and methacrylic acid.

Preferred crosslinkers are ethylene glycol dimethacrylate, diallyl phthalate, ortho-, meta- and para divinylbenzene, tetraallyloxyethane, and polyallylsaccharoses containing 2 to 5 alkyl groups per molecule of saccharin.

The above described grafted and crosslinked copolymers are formed preferably of:

i) 5 to 85% by weight of at least one monomer of the non-ionic type, ii) 3 to 80% by weight of at least one monomer of the ionic type, iii) 2 to 50% by weight, preferably 5 to 30% by weight, of polyethylene glycol, and iv) 0.1 to 8% by weight of a crosslinker, the percentage of the crosslinker being defined by the ratio of the overall weights of i), ii) and iii).

copolymers obtained by copolymerizing at least one monomer from each of the three following groups:

i) esters of unsaturated alcohols and short-chain saturated carboxylic acids and/or esters of short-chain saturated alcohols and unsaturated carboxylic acids, ii) unsaturated carboxylic acids, iii) esters of long-chain carboxylic acids and unsaturated alcohols and/or esters of the carboxylic acids of group ii) with saturated or unsaturated, straight-chain or branched $C_{8-18}$ alcohols Short-chain carboxylic acids and alcohols here are those having 1 to 8 carbon atoms, it being possible for the carbon chains of these compounds to be interrupted, if desired, by divalent hetero-groups such as —O—, —NH—, and —S—.

terpolymers of crotonic acid, vinyl acetate and an allyl or methallyl ester These terpolymers comprise monomer units of the general formulas (II) and (IV) (see above) as well as monomer units of one or more allyl or methallyl esters of formula (VII):

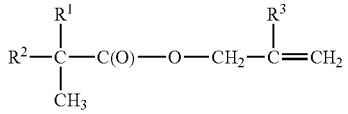

(VII)

in which $R^3$ is —H or $CH_3$, $R^2$ is $CH_3$ or $—CH(CH_3)_2$ and $R^1$ is $CH_3$ or a saturated straight-chain or branched $C_{1-6}$ alkyl group and the sum of the carbon atoms in the groups $R^1$ and $R^2$ is preferably 7, 6, 5, 4, 3 or 2.

The above mentioned terpolymers result preferably from the copolymerization of 7 to 12% by weight of crotonic acid, 65 to 86% by weight, preferably 71 to 83% by weight, of vinyl acetate and 8 to 20% by weight, preferably 10 to 17% by weight, of allyl or methallyl esters of the formula (VII).

tetra- and pentapolymers of i) crotonic acid or allyloxyacetic acid ii) vinyl acetate or vinyl propionate iii) branched allyl or methallyl esters iv) vinyl ethers, vinyl esters or straight chain allyl or methallyl esters crotonic acid copolymers with one or more monomers from the group consisting of ethylene, vinylbenzene, vinyl methyl ether, acrylamide and the water-soluble salts thereof terpolymers of vinyl acetate, crotonic acid and vinyl esters of a saturated aliphatic branched monocarboxylic acid.

Cationic polymers are additional inventively employable polymers. The permanently cationic polymers are preferred cationic polymers. "Permanently cationic" refers, according to the invention, to those polymers, which independently of the pH of the medium, have a cationic group. These are generally polymers, which comprise a quaternary nitrogen atom in the form of an ammonium group, for example.

Preferred cationic polymers are, for example quaternized cellulose derivatives, commercially available under the trade names Celquat® and Polymer JR®. The compounds Celquat® H 100, Celquat® L 200 and Polymer JF®400 are preferred quaternized cellulose derivatives.

polysiloxanes with quaternary groups, such as, for example, the commercially available products Q2-7224 (manufacturer: Dow Corning; a stabilized trimethylsilylamodimethicone), Dow Corning® 929 emulsion (comprising a hydroxylamino-modified silicone, also referred to as amodimethicone), SM-2059 (manufacturer: General Electric), SLM-55067 (manufacturer: Wacker), and Abil®-Quat 3270 and 3272 (manufacturer: Th. Goldschmidt; diquaternary polydimethylsiloxanes, Quaternium-80), cationic guar derivatives, such as in particular the products marketed under the trade names Cosmedia® Guar and Jaguar®, polymeric dimethyldiallylammonium salts and their copolymers with esters and amides of acrylic acid and methacrylic acid. The commercially available products Merquat® 100 (poly(dimethyldiallylammonium chloride)) and Merquat®550 (dimethyldiallylammonium chloride-acrylamide copolymer) are examples of such cationic polymers.

copolymers of vinyl pyrrolidone with quaternized derivatives of dialkylamino acrylate and dialkylamino methacrylate, such as, for example vinyl pyrrolidone-dimethylaminoethyl methacrylate copolymers quaternized with diethyl sulfate. Such compounds are commercially available under the trade names Gafquat®734 and Gafquat®755.

vinyl pyrrolidone-methoimidazolinium chloride copolymers, as offered under the designation Luviquat®.

quaternized polyvinyl alcohol and also the polymers known under the designations Polyquaternium 2, Polyquaternium 17, Polyquaternium 18 and Polyquaternium 27 having quaternary nitrogen atoms in the polymer main chain. The cited polymers are designated here according to the INCl nomenclature.

Inventively preferred cationic polymers are quaternized cellulose derivatives as well as polymeric dimethyldiallylammonium salts and their copolymers. Cationic cellulose derivatives, especially the commercial product Polymer®JR 400, are quite particularly preferred cationic polymers. The addition of the cationic polymers can contribute by further improving the fragrant effect of the film under use. In particular, the odor of a perfumed aqueous system can be further improved such that the fragrance lasts longer and is preferably more intensive for the same amount of added odoriferous compound. The absorbency of the odoriferous compound on substrates treated with/in the perfumed aqueous system, such as e.g. fabrics, can also be improved, such that the pleasing odor of the substrate lasts longer and is preferably more intensive.

The addition of cationic polymer is then particularly effective when preferably >2 wt. %, advantageously >4 wt. %, especially >6 wt. % of the cationic polymer are comprised in the shaped article, the wt. % being based on the totality of the shaped article. Upper limits can be e.g. at 30, 20 or 10 wt. % cationic polymer, based on the totality of the shaped article.

The material of the shaped article (or the film material) can comprise, in addition to the preferably water-soluble polymer or water-dispersible polymer, additional ingredients that in particular improve the processability of the starting materials into the film. These are particularly plasticizers and mold release agents. Moreover, dyes as well as optical brighteners can be incorporated into the films so as to achieve esthetic effects.

Suitable mold release agents that can be preferably deposited on the finished, dried films are e.g. talcum, starch or (physically, chemically and/or enzymatically) modified starch. Suitable chemical modifications are e.g. crosslinking, acetylation, esterification, hydroxyethylation, hydroxypropylation, phosphorylation. The preferably hydrophobic release agent adheres in particular externally on the film.

A possible blocking of the films, e.g. as a result of storage or high air humidity, can be effectively prevented by treating the films with a powdered release agent.

In particular, hydrophilic, high-boiling liquids may be used according to the invention as plasticizers, wherein materials that are solid at room temperature can also be used in the form of solutions, dispersions or melts, when needed. Particularly preferred plasticizers come from the group glycol, di-, tri-, tetra-, penta-, hexa-, hepta-, octa-, nona-, deca-, undeca-, dodecaethylene glycol, glycerine, neopentyl glycol, trimethylolpropane, pentaerythritol, mono-, di-, triglycerides, surfactants, especially non-ionic surfactants and mixtures thereof. Plasticizers are preferably added in amounts of 1 to 50 wt. %, preferably 2 to 40 wt. %, especially 5 to 30 wt. %. Upper limits can also be at e.g. 20 or 10 wt. % plasticizer, based on the totality of the shaped article.

Particularly suitable plasticizers are presented below.

Ethylene glycol (1,2-ethane diol, "glycol") is a colorless, viscous, sweet tasting, strongly hygroscopic liquid that is miscible with water, alcohols and acetone, and has a density of 1.113. The freezing point of ethylene glycol is at −11.5° C.; the liquid boils at 198° C. Ethylene glycol is obtained industrially by heating ethylene oxide with water under pressure. Promising manufacturing processes can also be based on the acetoxylation of ethylene and subsequent hydrolysis or on syngas reactions.

Diethylene glycol (2,2'-oxydiethanol, Digol), $HO—(CH_2)_2—O—(CH_2)_2—OH$, is a colorless, viscous, hygroscopic, sweet tasting liquid, density 1.12 and melts at −6° C. and boils at 245° C. Diglycol is miscible in all proportions with water, alcohols, glycol ethers, ketones, chloroform, but not with hydrocarbons or oils. Diethylene glycol, mostly known in the trade as simply diglycol, is manufactured from ethylene oxide and ethylene glycol (ethoxylation) and is therefore practically the initial member of the polyethylene glycols (see above).

Glycerine is a colorless, clear, highly viscous, odorless, sweet tasting, hygroscopic liquid, density 1.261, which solidifies at 18.2° C. Originally, glycerine was only a by-product of fat saponification, but is now synthesized industrially in large quantities. Most industrial processes are based on propylene, which is converted to glycerine via the intermediates allyl chloride, epichlorohydrin. A further industrial process is the hydroxylation of allyl alcohol over $WO_3$ with hydrogen peroxide via the glycid step.

Trimethylol propane [TMP, etriol, ettriol, 1,1,1-tris(hydroxymethyl)propane] chemically correctly described as 2-ethyl-2-hydroxymethyl-1,3-propane diol, is commercially available as a colorless, hygroscopic substance with a melting point of 57-59° C. and a boiling point of 160° C. (7 hPa). It is soluble in water, alcohol, acetone, but insoluble in aliphatic and aromatic hydrocarbons. It is manufactured by the reaction of formaldehyde with butyraldehyde in the presence of alkalies.

Pentaerythritol[2,2-bis(hydroxymethyl)-1,3-propane diol, Penta, PE] is a white, crystalline powder with a sweet taste and is neither hygroscopic nor inflammable, density 1.399, melting point 262° C. and boiling point 276° C. (40 hPa). Pentaerythritol is highly soluble in boiling water, is poorly soluble in alcohol, and insoluble in benzene, tetrachloromethane, ether, petroleum ether. Pentaerythritol is manufactured industrially by reacting formaldehyde with acetaldehyde in an aqueous solution of $Ca(OH)_2$ or NaOH at 15-45° C. The reaction takes place initially as an aldol reaction, whereby the formaldehyde reacts as the carbonyl component and the acetaldehyde as the methylene component. Due to the high carbonyl activity of the formaldehyde, the reaction of acetaldehyde with itself hardly occurs. Finally, the tris(hydroxymethyl)acetaldehyde undergoes a crossed Cannizzaro reaction with formaldehyde to afford pentaerythritol and formate.

Mono-, di-, triglycerides are esters of fatty acids, preferably long chain fatty acids with glycerine, wherein according to the glyceride type, one two or three OH groups are esterified. Acid components that can be esterified with glycerine to form mono-, di- or triglycerides as suitable plasticizers according to the invention, are, for example hexanoic acid (capronic acid), heptanoic acid (enanthic acid), octanoic acid (caprylic acid), nonanoic acid (pelargonic acid), decanoic acid (caprinic acid), undecanoic acid etc. In the context of the present invention, preferred fatty acids are dodecanoic acid (lauric acid), tetradecanoic acid (myristic acid), hexadecanoic acid (palmitic acid), octadecanoic acid (stearic acid), eicosanoic acid (arachinic acid), docosanoic acid (behenic acid), tetracosanoic acid (lignoceric acid), hexacosanoic acid (cerotic acid), triacotanoic acid (melissinic acid) as well as the unsaturated series 9c-hexadecenoic acid (palmitoleic acid), 6c-octadecenoic acid (petroselic acid), 6t-octadecenoic acid (petroselaidinic acid), 9c-octadecenoic acid (oleic acid), 9t-octadecenoic acid (elaidinic acid), 9c,12c-octadecadienoic acid (linoleic acid), 9t,12t-octadecadienoic acid (linolaidinic acid) und 9c,12c,15c-octadecatrienoic acid (linolenic acid). On the grounds of cost, natural fats (triglycerides) or modified natural fats (partially hydrolysed oils and fats) can also be used directly. Alternatively, mixtures of fatty acids can be manufactured by cleaving natural fats and oils and separated in a subsequent step, the purified fractions being reacted once more to afford mono-, di- or triglycerides. Acids that are esterified here with glycerine are in particular coco oil fatty acid (ca. 6 wt. % $C_8$, 6 wt. % $C_{10}$, 48 wt. % $C_{12}$, 18 wt. % $C_{14}$, 10 wt. % $C_{16}$, 2 wt. % $C_{18}$, 8 wt. % $C_{18}$, 1 wt. % $C_{18}$), palm nut oil fatty acid (ca. 4 wt. % $C_8$, 5 wt. % $C_{10}$, 50 wt. % $C_{12}$, 15 wt. % $C_{14}$, 7 wt. % $C_{16}$, 2 wt. % $C_{18}$, 15 wt. % $C_{18'}$, 1 Wt. % $C_{18''}$), tallow fatty acid (ca. 3 wt. % $C_{14}$, 26 wt. % $C_{16}$, 2 wt. % $C_{16}$, 2 wt. % $C_{17}$, 17 wt. % $C_{18}$, 44 wt. % $C_{18'}$, 3 wt. % $C_{18''}$, 1 wt. % $C_{18'''}$), hydrogenated tallow fatty acid (ca. 2 wt. % $C_{14}$, 28 wt. % $C_{16}$, 2 wt. % $C_{17}$, 63 wt. % $C_{18}$, 1 wt. % $C_{18'}$), industrial oleic acid (ca. 1 wt. % $C_{12}$, 3 wt. % $C_{14}$, 5 wt. % $C_{16}$, 6 wt. % $C_{16'}$, 1 wt. % $C_{17}$, 2 wt. % $C_{18}$, 70 wt. % $C_{18'}$, 10 wt. % $C_{18''}$, 0.5 wt. % $C_{18'''}$), industrial palmitic/stearic acid (ca. 1 wt. % $C_{12}$, 2 wt. % $C_{14}$, 45 wt. % $C_{16}$, 2 wt. % $C_{17}$, 47 wt. % $C_{18}$, 1 wt. % $C_{18'}$) as well as soya bean oil fatty acid (ca. 2 wt. % $C_{14}$, 15 wt. % $C_{16}$, 5 wt. % $C_{18}$, 25 wt. % $C_{18'}$, 45 wt. % $C_{18''}$, 7 wt. % $C_{18'''}$).

Surfactants, particularly non-ionic surfactants can also be considered for use as additional plasticizers. Preferred non-ionic surfactants are alkoxylated, advantageously ethoxylated, particularly primary alcohols preferably containing 8 to 18 carbon atoms and, on average, 1 to 12 moles of ethylene oxide (EO) per mole of alcohol, in which the alcohol group may be linear or, preferably, methyl-branched in the 2-position or may contain e.g. linear and methyl-branched groups in the form of the mixtures typically present in oxo alcohol groups. Particularly preferred are, however, alcohol ethoxylates with linear groups from alcohols of natural origin with 12 to 18 carbon atoms, e.g. from coco-, palm-, tallow- or oleyl alcohol, and an average of 2 to 8 EO per mole alcohol. Exemplary preferred ethoxylated alcohols include $C_{12-14}$ alcohols with 3 EO or 4EO, $C_{9-11}$ alcohol with 7 EO, $C_{13-15}$ alcohols with 3 EO, 5 EO, 7 EO or 8 EO, $C_{12-18}$ alcohols with 3 EO, 5 EO or 7 EO and mixtures thereof, as well as mixtures of $C_{12-14}$ alcohol with 3 EO and $C_{12-18}$ alcohol with 5 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are tallow fatty alcohol with 14 EO, 25 EO, 30 EO or 40 EO.

Non-ionic surfactants that have a melting point above room temperature are used with particular preference as plasticizers. Accordingly, preferred shaped articles are characterized in that non-ionic surfactant(s) with a melting point above 20° C., preferably above 25° C., particularly preferably between 25 and 60° C. and, especially between 26.6 and 43.3° C. are used as plasticizers.

Suitable non-ionic surfactants with a melting and/or softening point in the cited temperature range are, for example weakly foaming non-ionic surfactants that can be solid or highly viscous at room temperature. If non-ionic surfactants are used that are highly viscous at room temperature, they preferably have a viscosity above 20 Pas, particularly preferably above 35 Pas and especially above 40 Pas. Non-ionic surfactants that have a waxy consistency at room temperature are also preferred.

Preferred non-ionic surfactants that are solid at room temperature are used and belong to the groups of alkoxylated non-ionic surfactants, more particularly ethoxylated primary alcohols, and mixtures of these surfactants with structurally more complex surfactants, such as polyoxypropylene/polyoxyethylene/polyoxypropylene (PO/EO/PO) surfactants.

In one preferred embodiment of the present invention, the non-ionic surfactant with a melting point above room temperature is an ethoxylated non-ionic surfactant that results from the reaction of a monohydroxyalkanol or alkylphenol containing 6 to 20 carbon atoms with preferably at least 12 moles, particularly preferably at least 15 moles and especially at least 20 moles of ethylene oxide per mole of alcohol or alkylphenol.

A particularly preferred non-ionic surfactant that is solid at room temperature is obtained from a straight-chain fatty alcohol containing 16 to 20 carbon atoms ($C_{16-20}$ alcohol), preferably a $C_{18}$ alcohol, and at least 12 moles, preferably at least 15 moles and more preferably at least 20 moles of ethylene oxide. Of these non-ionic surfactants, the so-called narrow range ethoxylates (see above) are particularly preferred.

Ethoxylated non-ionic surfactant(s) can preferably be employed that were obtained from $C_{6-20}$-monohydroxy alkanols or $C_{6-20}$-alkyl phenols or $C_{16-20}$-fatty alcohols and more than 12 mole, preferably more than 15 mole and especially more than 20 mole ethylene oxide per mole alcohol, Preferably, the non-ionic surfactant can additionally possess propylene oxide units in the molecule. These PO units preferably make up as much as 25% by weight, more preferably as much as 20% by weight and, especially up to 15% by weight of the total molecular weight of the non-ionic surfactant. Particularly preferred non-ionic surfactants are ethoxylated monohydroxyalkanols or alkylphenols, which have additional polyoxyethylene-polyoxypropylene block copolymer units. The alcohol or alkylphenol component of these non-ionic surfactant molecules preferably makes up more than 30 wt. %, more preferably more than 50 wt. % and most preferably more than 70 wt. % of the total molecular weight of these non-ionic surfactants.

Other particularly preferred non-ionic surfactants with melting points above room temperature contain 40 to 70% of a polyoxypropylene/polyoxyethylene/polyoxypropylene block polymer blend which contains 75% by weight of an inverted block copolymer of polyoxyethylene and polyoxypropylene with 17 moles of ethylene oxide and 44 moles of propylene oxide and 25% by weight of a block copolymer of polyoxyethylene and polyoxypropylene initiated with trimethylol propane and containing 24 moles of ethylene oxide and 99 moles of propylene oxide per mole of trimethylol propane.

Additionally preferred non-ionic surfactants satisfy the formula $$R^1O[CH_2CH(CH_3)O]_x[CH_2CH_2O]_y[CH_2CH(OH)R^2],$$

in which $R^1$ stands for a linear or branched aliphatic hydrocarbon group with 4 to 18 carbon atoms or mixtures thereof, $R^2$ means a linear or branched hydrocarbon group with 2 to 26 carbon atoms or mixtures thereof and x stands for values between 0.5 and 1.5 and y stands for a value of at least 15.

Other preferred non-ionic surfactants are the end-capped poly(oxyalkylated) non-ionic surfactants corresponding to the Formula $$R^1O[CH_2CH(R^3)O]_x[CH_2]_kCH(OH)[CH_2]_jOR^2$$

in which $R^1$ and $R^2$ stand for linear or branched, saturated or unsaturated, aliphatic or aromatic hydrocarbon groups with 1 to 30 carbon atoms, $R^3$ stands for H or for a methyl, ethyl, n-propyl, isopropyl, n-butyl, 2-butyl or 2-methyl-2-butyl group, x stands for values between 1 and 30, k and j for values between 1 and 12, preferably between 1 and 5. Each $R^3$ in the above formula can be different for the case where x≥2. $R^1$ and $R^2$ are preferably linear or branched, saturated or unsaturated, aliphatic or aromatic hydrocarbon groups containing 6 to 22 carbon atoms, groups containing 8 to 18 carbon atoms being particularly preferred. H, —$CH_3$ or —$CH_2CH_3$ are particularly preferred for the group $R^3$. Particularly preferred values for x are in the range from 1 to 20 and more particularly in the range from 6 to 15.

As described above, each $R^3$ in the above formula can be different for the case where x≥2. By this means, the alkylene oxide unit in the straight brackets can be varied. If, for example, x has a value of 3, then the substituent $R^3$ may be selected to form ethylene oxide ($R^3$=H) or propylene oxide ($R^3$=$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to $$R^1O[CH_2CH(R^3)O]_xCH_2CH(OH)CH_2OR^2$$

In this last formula, $R^1$, $R^2$ and $R^3$ are as defined above and x stands for a number from 1 to 30, preferably 1 to 20 and especially 6 to 18. Surfactants in which the substituents $R^1$ and $R^2$ have 9 to 14 carbon atoms, $R^3$ stands for H and x takes a value of 6 to 15 are particularly preferred.

Further preferred substances for use as plasticizers can be glycerine carbonate, propylene glycol and propylene carbonate.

Glycerine carbonate is obtained by the transesterification of ethylene carbonate or dimethyl carbonate with glycerine, producing ethylene glycol or methanol as by-products. A further synthesis starts with glycidol (2,3-epoxy-1-propanol), which is reacted under pressure with $CO_2$ in the presence of catalysts to form glycerine carbonate. Glycerine carbonate is a clear liquid of low viscosity with a density of 1.398 $g \cdot cm^{-3}$ that boils at 125-130° C. (0.15 mbar).

Two isomers of propylene glycol exist, 1,3-propane diol and 1,2-propane diol. 1,3-Propane diol (trimethylene glycol) is a neutral, colorless and odorless, sweet tasting liquid of density 1.0597, which solidifies at −32° C. and boils at 214° C. 1,3-Propane diol is manufactured from acrolein and water followed by catalytic hydrogenation.

By far the more industrially important 1,2-propanediol (propylene glycol) is an oily, colorless, almost odorless liquid, density 1.0381, solidifying at −60° C. and boiling at 188° C. 1,2-Propane diol is manufactured by adding water to propylene oxide.

Propylene carbonate is a water-white liquid of low viscosity with a density of 1.21 $g \cdot cm^{-3}$; the melting point is −49° C., the boiling point at 242° C. Propylene carbonate is industrially obtainable from the reaction of propylene oxide and $CO_2$ at 200° C. and 80 bar.

Highly dispersed silicic acids are particularly suitable as further additives that are preferably solid at room temperature. Pyrogenic silicic acids such as commercial Aerosil® or precipitated silicic acids are available. Particularly preferred processes according to the invention are characterized in that one or more materials from the group (preferably highly dispersed) silicic acid, dispersion powder, high molecular weight polyglycols, stearic acid and/or stearic acid salts, and from the group of inorganic salts such as sodium sulfate, calcium chloride and/or from the group of inclusion hosts such as urea, cyclodextrin and/or from the group of the superabsorbants such as (preferably crosslinked) polyacrylic acid and/or their salts like Cabloc 5066/CTF and their mixtures is/are used as additional additives.

Inventively preferred shaped articles can comprise colorants. Suitable colorants preferably exhibit a high storage stability, are not affected by the other ingredients of the composition or by light and do not have any pronounced substantivity for the substrates such as glass, ceramics or plastic dishes being treated with the colorant-containing agent, so as not to color them.

Care must be taken when choosing the dye so that the dyes possess a high storage stability and are insensitive towards light. At the same time, the different stabilities of dyes towards oxidation must also be borne in mind when choosing suitable dyes. In general, water-insoluble dyes are more stable than water-soluble dyes to oxidation. The concentration of the dye in the shaped articles is varied depending on the solubility and hence also on the propensity to oxidation. For dyes that are readily soluble in water, dye concentrations in the range of some $10^{-2}$ to $10^{-3}$ wt. % are typically selected, based on the totality of the shaped articles. For the less readily water-soluble, but due to their brilliance, particularly preferred pigment dyes, their suitable concentration, in contrast, is typically several $10^{-3}$ to $10^{-4}$ wt. %, based on the totality of the shaped articles.

Those dyes are preferred that can be oxidatively destroyed in a washing process, as well as mixtures thereof with suitable blue colorants, the "blue toners". It has also proved advantageous to employ dyes that are soluble in water or in liquid organic substances at room temperature. Anionic dyes, for example anionic nitroso dyes, are suitable.

As optical brighteners, which can be preferably comprised in the inventive shaped articles, 1,3,5-triazinyl derivatives of 4,4'-diamino-2,2'-stilbene disulfonic acid (flavonic acid), 4,4'-distyrylbiphenylene, hymecromone (methylumbelliferone), coumarin, dihydroquinolinone, 1,3-diarylpyrazoline, naphthalic acid imide, benzoxazole systems, benzisoxazole- and benzimidazole systems linked through CH=CH bonds and pyrene derivatives substituted by heterocycles are suitable, for example.

According to a preferred embodiment of the invention, the inventive shaped articles, especially the inventive sheets (films), are not packaging materials for liquids or solids such as e.g. laundry detergents or cleaning agents, i.e. they are not film material from laundry detergent pouches or the like.

The inventive shaped articles, especially the inventive films, can be manufactured by all known processes, wherein, however, the casting process is seen as very advantageous.

Film manufacture by thermoplastic processing by calendaring or extrusion is very preferred. Coextrusion is especially preferred.

The blown film process and the flat film process are inventively very preferred processes for manufacturing the films. The manufacture of blown film is known. For example, the polymeric material such as e.g. PVOH powder is initially dry-blended with additives and stabilizers. This mixture is then melted in the heated extruder. The inventively required odoriferous substances can be added for example to the melt. The melt is then blown, the film is cooled and preferably reeled up.

Blown films are generally more cheaply produced than cast films, but the variation in film thickness can vary somewhat more and more air inclusions can perhaps arise however, which can be undesirable. As a rule, blown films are somewhat tougher and have less resilient properties than cast films, whereas the latter can be soft, flexible, nearly almost rubbery and also possess high resilience.

When films are manufactured from solutions of polymers then this is termed a cast process. According to the invention, the polymer solutions can be manufactured by adding solvents, which is preferred, or by the chemical conversion of insoluble macromolecules into soluble derivatives. The inventively required odoriferous substances can be added for example to the polymer solution. There are several methods for converting the polymer solution into films. When the polymer solution is precipitated out in a bath then this is called a wet casting process. For example, in cellophane manufacturing, a highly viscous cellulose solution is forced through a slot-cast die into a strongly acidic precipitation bath. When the solvent evaporates, thereby yielding the polymer as a film, then this is called a dry casting process; belt casting machines or drum casting machines are principally used to carry out this process.

In the belt casting process (also called cast process or chill roll process), which is inventively preferably employed, the polymer solution that according to the invention comprises odoriferous substances is cast from a storage tank, preferably through a die, usually onto an endless, preferably highly polished, metal belt. The belt speeds depend strongly on the material employed and on the targeted film thickness. Preferably, they can be between 2 and 60 meters per minute. After the major part of the solvent has been evaporated, the film can be peeled off. It is wound up preferably after drying in a circulating hot air drier or over heated rollers. In this process, the resulting film thicknesses can be 15 to 300 μm, for example. It is possible and preferred to firstly force the polymer solution through a filter before casting it onto the metal band in order to retain undissolved particles that could otherwise lead to the formation of so called protrusions/specks. It is likewise possible and preferred to eliminate, at least partially, retained air in the polymer solution in a degassing vessel before casting it onto the metal plate. The optional degassing is advantageously carried out prior to adding the fragrance.

For manufacturing films such as e.g. PVOH films in the casting process, the e.g. PVOH powder/granule and plasticizer (e.g. PEG and/or glycerine) are dissolved in water in a make-up vessel. The solution is then transferred to a storage reservoir. The solution is then heated to e.g. ca. 80° C. and subsequently fed through a slot cast die to a roller. The solution is formed into a film in the drying process (hot air channel). In this case, according to the invention, e.g. perfume oils can be added to the PVOH mixture in the make-up vessel.

The drum casting process is similar to the belt casting process. Here, instead of the metal belt, heated drums are used with about 2-3 m diameter and widths of about 2 m.

As in the cast process, films are obtained that usually have a constant uniform film thickness distribution and few air inclusions; however, the process is expensive due to the energy intensive drying. Thinner films can be manufactured in the cast process than in the blown film process. High water contents can also be set, e.g. 5-8 wt. % water, based on the whole film.

The cast process is preferred for those substances that do not melt or only melt with decomposition, such as e.g. cellulose or polyimides. The cast process is likewise preferred for manufacturing very thin films.

Roller processes or sinter processes are in principle also possible for manufacturing films, but only make sense in exceptional cases, e.g. manufacturing tetrafluoroethylene films and polyimide films.

A process for manufacturing a film is also possible for example, wherein one or more polymers are first dissolved or dispersed in a liquid carrier medium to produce a rollable preparation, and this is subsequently converted into the form of a film by rolling in a rolling device. The liquid carrier medium can be evaporated at the same time or subsequently.

A liquid carrier medium preferably includes solvents or dispersion agents such as water, alcohols, ethers or hydrocarbons or mixtures of two or more of the cited substances, wherein the substances or mixtures of substances are liquid at room temperature (20° C.). Exemplary suitable alcohols are the mono or polyhydric alcohols containing 1 to 5 carbon atoms such as e.g. ethanol, isopropanol, ethylene glycol, glycerine and propylene glycol.

The content of the liquid carrier medium in the rollable preparation can be e.g. in the range 20 to 90 wt. % or 30 to 70 wt. %.

A suitable rollable preparation can have e.g. a semi-solid or pasty consistency or it can be a viscous liquid, with which a suitable carrier can be coated and be rolled with a roller device to yield the desired film thickness. After drying, the finished film is then removed from the carrier. Suitable carrier materials can be selected from e.g. the group silicon, metal, metallized polymers, polytetrafluoroethylene, polyether/polyamide block copolymers, polyurethanes, polyvinyl chloride, nylon, alkylene/styrene copolymers, polyethylene, polyester or other, releasable materials. Suitable rolling devices are e.g. the known 'forward roll' or 'reverse roll' coaters equipped with at least two co rotating or counter rotating cylinders or rollers, a reverse roll coater being preferred.

The resulting films (from any of the possible processes) can be subsequently treated, for example by evaporation deposition, coating, printing or flock coating. It is also possible to perfume the film once the film has actually been manufactured, e.g. by spraying, coating or dipping the film into a perfume-containing preparation. However, it is preferred to perfume the film as it is being manufactured. A coupled process is also possible, in which the film is perfumed as it is being manufactured and the finished film is also perfumed a second time, e.g. by spraying.

In a preferred embodiment of the invention, the inventive films are foamed films. Foamed films are obtained by enclosing gas bubbles of a suitable gas, such as e.g. air, into the films. Such films with enclosed gas bubbles are characterized by a particularly good surface feel. Moreover, they can exhibit an improved water solubility. Preferred films, such as foamed films in particular, have a density of <1 kg/m$^2$.

Various methods are available for incorporating the gas bubbles. Thus, a blowing agent or propellant can be used for example. Foaming can be achieved by e.g. mechanical stirring of the still liquid or viscous carrier compound. For example, a chemical reaction that generates a gas can be instigated. For example, a highly volatile solvent can be used that is evaporated at increased temperatures. For example, a gas or a liquefied gas can be introduced into the still viscous carrier compound.

However, it can be preferred to use blowing agents. They are substances that decompose on heating and evolve gas, with the result that e.g. nitrogen or carbon dioxide are released.

Carbonates, hydrogen carbonates, borohydrides, silicon oxyhydrides etc. are examples of suitable inorganic blowing agents. However, all organic blowing agents known to be employed in the manufacture of porous or bubble-containing plastics, can also be preferably utilized. Inventive films, such as preferably foamed films, can also be in the form of confetti. In the form of confetti means a large number of film shavings or film shreds. In general parlance, the term "confetti" is used for small, colored shreds of paper. Film in confetti form do not necessarily have to be as small as the known paper confetti that is principally thrown into the air at carnival processions and during other festivities, such as children's' birthdays or at weddings. The confetti form can be regular or irregular, for example it can be circular film shreds or it can be for example in heart-shaped film shreds. Any conceivable shape is possible and can be obtained for example by stamping the film confetti out of a larger film. The use of inventive films in confetti form can be advantageous e.g. when washing textiles by hand, when a given amount of the film in confetti form is dispersed into the textile treatment bath.

According to another, less preferred embodiment of the invention, the perfumed shaped article is neither a film nor a sheet but rather an advantageously inflexible particle with an at least ellipsoidal, spherical, cubic, parallelepiped, cylindrical, conical, pyramidal, toroidal and/or polyhedral shape, preferably a tablet, especially an effervescent tablet.

Effervescent tablets comprise mixtures of substances that generate gas when the tablet dissolves in water, e.g. carbon dioxide is released, e.g. from sodium hydrogen carbonate and organic acids such as for example tartaric acid or citric acid.

Similarly, the tablets can comprise substances that increase the porosity of the comprimate and are able to adsorb a large amount of water (e.g. starch, cellulose derivatives, alginates, dextrans, crosslinked polyvinyl pyrrolidone etc.). Hydrophilic promoters (e.g. inter alia polyethylene glycol sorbitol esters of fatty acids) can also be comprised and facilitate the wetting of the comprimate particle.

In order to facilitate the disintegration of the preconditioned shaped articles, disintegration aids, so-called tablet disintegrators, may be incorporated in these agents to shorten their disintegration times. Tablet disintegrators or disintegration accelerators are generally understood to mean auxiliaries that ensure a rapid disintegration of tablets in water or other media and the speedy release of the active substance.

These substances, which are also known as "disintegrators" by virtue of their effect, increase in volume on contact with water such that, firstly, their-own volume increases (swelling) and secondly, a pressure can also be generated by the release of gases, causing the tablet to disintegrate into smaller particles. Well-known disintegrators are, for example, carbonate/citric acid systems, although other organic acids may also be used. Swelling disintegration aids are, for example, synthetic polymers, such as polyvinyl pyrrolidone (PVP), or natural polymers and modified natural substances, such as cellulose and starch and derivatives thereof, alginates or casein derivatives.

The disintegration aids are preferably incorporated in quantities of 0.5 to 10 wt. %, advantageously from 3 to 7 wt. % and especially from 4 to 6 wt. %, each based on the total weight of the agent containing the disintegration aid.

Preferred disintegrators that are used are based on cellulose, and therefore preferred shaped articles comprise such a cellulose-based disintegrator in quantities from 0.5 to 10% by weight, advantageously 3 to 7% by weight and especially 4 to 6% by weight. Pure cellulose has the formal empirical composition $(C_6H_{10}O_5)_n$ and, formally, is a β-1,4-polyacetal of cellobiose that, in turn, is made up of two molecules of glucose. Suitable celluloses consist of ca. 500 to 5000 glucose units and, accordingly, have average molecular weights of 50 000 to 500 000. In the context of the present invention, cellulose derivatives obtainable from cellulose by polymer-analogous reactions may also be used as cellulose-based disintegrators. These chemically modified celluloses include, for example, products of esterification or etherification reactions in which hydroxyl hydrogen atoms have been substituted. However, celluloses in which the hydroxyl groups have been replaced by functional groups that are not attached by an oxygen atom may also be used as cellulose derivatives. The group of cellulose derivatives includes, for example, alkali metal celluloses, carboxymethyl cellulose (CMC), cellulose esters and ethers and amino celluloses. The cellulose derivatives mentioned are preferably not used on their own, but rather in the form of a mixture with cellulose as cellulose-based disintegrators. The content of cellulose derivatives in mixtures such as these is preferably below 50% by weight and more preferably below 20% by weight, based on the cellulose-based disintegrator. A particularly preferred cellulose-based disintegrator is pure cellulose, free from cellulose derivatives.

The cellulose, used as the disintegration aid, is advantageously not added in the form of fine particles, but rather conveyed in a coarser form prior to addition to the premix that will be compressed, for example granulated or compacted. The particle sizes of such disintegrators are mostly above 200 μm, advantageously with 90 wt. % between 300 and 1600 μm and particularly with at least 90 wt. % between 400 and 1200 μm.

Microcrystalline cellulose can be used as a further cellulose-based disintegration aid, or as an ingredient of this component. This microcrystalline cellulose is obtained by the partial hydrolysis of cellulose, under conditions, which only attack and fully dissolve the amorphous regions (ca. 30% of the total cellulosic mass) of the cellulose, leaving the crystalline regions (ca. 70%) intact. Subsequent disaggregation of the microfine cellulose, obtained by hydrolysis, yields microcrystalline celluloses with primary particle sizes of ca. 5 μm and for example, compactable granules with an average particle size of 200 μm.

Preferred disintegration aids, advantageously a disintegration aid based on cellulose, preferably in granular, cogranulated or compacted form, are comprised in the disintegration aid-containing agent in quantities of 0.5 to 10 wt. %, preferably 3 to 7 wt. % and particularly 4 to 6 wt. %, each based on the total weight of the disintegration aid-containing agent.

Moreover, according to the invention, it can be preferred to incorporate additional gas-evolving effervescing systems as the disintegration aids. The gas-evolving effervescent system can consist of a single substance, which liberates a gas on contact with water. Among these compounds, particular mention is made of magnesium peroxide, which liberates oxygen on contact with water. Normally, however, the gas-liberating effervescent system consists of at least two ingredients that react with one another to form gas. Although various possible systems could be used, for example systems releasing nitrogen, oxygen or hydrogen, the effervescent system used in the detergent and cleansing agent should be selected with both economic and ecological considerations in mind. Preferred effervescent systems consist of alkali metal carbonate and/or -hydrogen carbonate and an acidifying agent capable of releasing carbon dioxide from the alkali metal salts in aqueous solution.

Suitable acidifiers, which liberate carbon dioxide from alkali salts in aqueous solution, are for example, boric acid and alkali metal hydrogen sulfates, alkali metal dihydrogen phosphates and other inorganic salts Preferably, however, organic acidifiers are used, citric acid being a particularly preferred acidifier. Preferred acidifiers in the effervescing system are from the group of organic di-, tri- and oligocarboxylic acids or their mixtures.

The withdrawal receptacle can be any receptacle that is particularly suitable to at least encapsulate and/or hold together a shaped article that is preferably in film form.

The receptacle can be made of e.g. a flexible, semi-rigid or dimensionally stable material.

A dimensionally stable receptacle has the advantage of protecting in particular fragile shaped articles in film form from mechanical influences and corresponding damage.

The receptacle is preferably designed to be impermeable to water vapor in order to prevent any swelling or unintentional activation of the shaped article that is preferably in film form.

In order to prevent an unintentional emission of substances, such as fragrances, from the shaped article that is in film form, the receptacle is preferably designed to be impermeable to fragrances.

In another preferred embodiment of the invention, the receptacle is provided with a childproof opening so as to prevent an unintentional contact from children with the shaped articles that are preferably in film form.

In particular, metering aids and removal aids for the shaped articles that are preferably in film form are provided on the inventive receptacle.

A flexible receptacle can be e.g. a packaging bag, such as for example a flat sachet, sealed edge sachet, flat bottom bag, double bag, cavity sachet or hose sachet, e.g. a bag made of a multi-layer, film and flexible composite material, wherein the bag has preferably a tearing means, such as e.g. a tear strip or a tear notch.

It is conceivable to arrange the shaped filmed articles singly or plurally in a flexible receptacle.

The preferably filmed shaped articles packed in one or more receptacles can be destined for use in tape or sheet dispensers. Tape or sheet dispensers can also be used for unpackaged, preferably filmed shaped articles.

The withdrawal receptacle can also include a roller or consist of this. The flexible shaped article, preferably strip-shaped, sheet-shaped, disk-shaped or web-shaped, can also be wound up on a roller, wherein the shaped article is preferably provided with separation points for removing portions of it. Exemplary withdrawal receptacles are known from the field of adhesive tape rollers. Adhesive tape rollers fall under the generic term, tape dispenser. All tape dispensers can be suitable as the withdrawal receptacles.

Accordingly, if the withdrawal receptacle includes a roller, is preferably a tape dispenser, wherein the shaped article is especially provided with separation points for removing portions of it, then this is a preferred embodiment.

Devices, so called tape unrollers, also serve for the production of pieces of tape, by means of which the tape can be unwound from a roller and guided over a cutting element. When the free end of the tape has reached the required length, it is cut off with the cutting element. This device allows the consumer to decide the length of the tape to be cut off, in that he unwinds the tape to the required length and then cuts it off. To cut off the tape, the end of the tape has to be guided over the cutting element, typically a saw shaped saw-toothed metallic or plastic cutting blade that can effectively cut the tape. Such tape dispensers or the like can be advantageously employed according to the invention.

Refillable tape dispensers for the repeatable placement of a tape roll are particularly preferred.

Those tape dispensers are also particularly preferred that are known from e.g. the field of correction tape dispensers (film transfer rolls). When the inventive withdrawal receptacle is a film transfer roller, then this represents a preferred embodiment.

Receptacles for disbursing sheets or strips, so called leaf dispensers, are likewise appropriate. They are devices that contain a stack of sheets, strips or films etc. and include a metering aid or removal aid for the sheets, strips or films.

This stack is preferably designed such that on removing the top sheet, the sheet directly underneath is aligned such that it can be subsequently removed without difficulty. For example, on removing the top sheet from such devices having a removal slit, the next sheet is already brought far enough forward such that it already protrudes out of the removal slit and can be easily removed.

This concerns e.g. a block of sheets, each of which having a coating of a flexible polymer, which can be provided with a coating of repositionable pressure sensitive material on the second end region, while they are in any case free of adhesive along a visually recognizable first end region in a stack, wherein the contiguous ends of the sheets are aligned on top of one another and the first and the second ends of the one on top of one another succeeding sheets are arranged contiguously. The stack can be located in a chamber that is partially limited in the upper wall with a slit, through which protrudes the first end region of the topmost sheet. On taking out the topmost sheet through the slit, the relative movement between the upper wall and the topmost sheet causes the alignment of the slit to be reached by subsequent regions of the sheet as far as its second end, while these succeeding regions that are one on top of another are detached from the stack. The end region of the sheet underneath is moved with the end region of the topmost sheet through the slit causing the first end region of the underlying sheet to protrude out of the slit, when the topmost sheet is removed. These or similar sheet dispensing systems are inventively preferred.

According to a preferred embodiment, the fragrant medium dispensing system is configured such that it allows at least 3, 4, 5 or more different perfumed shaped articles to be removed. This can be a system for example that includes 3, 4 or 5 rolls of different perfumed films. This can also be called a set of 3, 4 or 5. In this case, the perfumed shaped articles differ in their perfume, with the result that the consumer can himself establish the overall perfume note by dosing the individual perfumed articles. Here, there are no limits set to the creativity of the consumer. The different perfumes can be advantageously indicated by the use of different colorations.

The shaped articles of a corresponding set configuration thereby advantageously comprise different odoriferous substances that can be preferably differentiated according to identified notes. These notes that can be comprised independently of one another in each inventive shaped article are e.g.:

- "green notes", i.e. fresh herbal notes that smell of leaves, grasses, meadows etc.,
- "citrus notes"; these consist mostly of ethereal oils from citrus fruits and have a refreshing smell,
- "lavender notes"; they have the typical lavender smell,
- "flowery notes" are for example composed of a plurality of individual flower notes, e.g. in the sense of jasmin, lilac, rose, lily of the valley, iris/violets an/or cloves etc.
- "aldehyde notes"; they are mainly based on synthetic odoriferous substances with flowery, partly also woody, balsamy and animal character
- "cyprus or mossy notes"; they consist mainly of oak moss extracts, in part combined with oil of bergamot, and have a fresh herbal smell.
- "fougère or fern notes; they are similar to the cypress notes.
- "spice notes"; they comprise mostly spice extracts from e.g. thyme, pepper, Muscat, cinnamon, clove, ginger, marjoram, cardamom, coriander etc., also including in part synthetic odoriferous substances and specifically combined spice bases.
- "oriental notes"; these combine spice notes with redolent, sweet, balsamic or animal notes to smell with a spicy-sweet to sweetish-rich character.
- "wood notes"; these are based on e.g. cedar wood oils, sandalwood oils and other wood oils and root oils and vary from fresh herbal to woody herbal.
- "tobacco notes"; these are available in many variations from freshly herbal-spicy to richly sweet-honey like, originally based on the smell of tobacco leaves and fermented tobacco.
- "leather notes"; these have the smell of the finest leather goods e.g. recalling the smell of birch.

Another withdrawal receptacle concerns dosing dispensers for shaped articles. Dosing dispensers of this type usually consist of a housing with a storage chamber, the floor of which has an outlet that opens into a guide for a valve with pressure plate and with a return spring, wherein the valve, in its rest position, possesses a channel located under the outlet, whose spout opening, in the rest position, is covered by a cover sheet.

Dosing dispensers of this type can comprise perfumed shaped articles, so that in such a case one can speak of a fragrant medium dispensing system. The dimensions of the corresponding dosing dispenser are naturally matched to the dimensions of the shaped article in question. Dosing dispensers of this type can be inventively preferred.

The present invention allows the person skilled in the art a considerable freedom of action in perfuming aqueous systems, in such a way that he no longer has to produce aqueous systems with quite individual, refined fragrant notes.

For appropriate applications, the consumer can also set up an additional utilization for aromatherapy. For example, natural fragrances of ethereal oils can be used. Typical examples are chamomile, rosemary, thyme, jasmine, peppermint and sandalwood. Thus, by choosing the fragrances, the consumer can influence his subjective sense of well being, and can attend to e.g. psychosomatically caused discomfort such as for example nervousness or stress by using appropriately perfumed shaped articles. Appropriate shaped articles can also be employed as a help in order to support the subjective well being in the case of colds or nervous gastrointestinal afflictions. However, this does not concern in the actual sense a therapeutic method, but rather a cosmetic olfactory method.

The already described set configuration is also suitable for example for the creation of a fragrance carousel. Carousel configurations are known in particular in the field of spice carousels. They are generally rotatable entities that comprise at least 4 or more, for example up to 12 individual removable receptacles that are arranged circumferentially on a stand or on a holder. A fragrance carousel of this type with e.g. 12 receptacles that contain different perfumed shaped articles can even be called a "fragrance organ", with which the consumer can compose an individualized fragrance.

According to a preferred embodiment, the inventive shaped article comprises at least 12 wt. % perfume, preferably at least 15 wt. % perfume, especially at least 20 wt. % perfume, based on the whole shaped article. Similarly, the shaped article can also comprise greater amounts of perfume, e.g. at least 25, 30, 35, 40, 45 or even at least 60 wt. % perfume. Realistic upper limits of perfume can be e.g. 80 wt. %, 75 wt. %, 70 wt. %, 65 wt. %, 60 wt. %, 55 wt. %, 50 wt. %, 45 wt. %, 40 wt. %, 35 wt. %, 30 wt. %, 25 wt. %, 20 wt. %, 15 wt. % or also 10 wt. %.

When the comprised perfume consists of at least 5, 10 or 15 wt. % of odoriferous substances having a boiling point above 250° C. and a log P value of ≥3.0, then this is a preferred embodiment. It appears that inventive shaped articles that comprise such minimum amounts of odoriferous substances having a boiling point above 250° C. and a log P value of ≥3.0 exhibit particularly advantageous fragrant properties. For example, a longer lasting fragrant impression can be achieved when the shaped article is used in aqueous systems. Similarly, the absorption behavior of the odoriferous compound on substrates treated in/with the perfumed aqueous system can be further improved, such that the odor of the substrates, especially textiles, lasts longer and is more intensive.

The octanol/water distribution coefficient of a fragrance ingredient is the ratio between its equilibrium concentration in octanol and water. As the distribution coefficients of the fragrant ingredients often have high values, e.g. 1000 or more, they are more conveniently reported in the form of their logarithm base 10; this is then the so called log P value. Preferred odoriferous substances of this invention possess a log P of ≥3.0 or higher, e.g. ≥3.1, preferably ≥3.2, especially ≥3.3.

The log P value of a large number of odoriferous substances is documented; for example the Pomona92 Databank, available from Daylight Chemical Information Systems, Inc., (Daylight CIS), Irvine, Calif., contains a great many log P values, together with references to the original literature. Most conveniently, however, the log P values are calculated by the "CLOGP" program that is also available from Daylight CIS. This program also quotes the experimental log P values in so far as they are available in the Pomona92 Databank. The "calculated log P" (Clog P value) is calculated by fragment approximation according to Harsch and Leo (see A. Leo, in Comprehensive Medicinal Chemistry, vol. 4, C. Harsch, P. G. Sammens, J. B. Taylor and C. A. Ransden, Ed., p. 295, Pergamon Press, 1990, incorporated herein by reference). The fragment approximation is based on the chemical structure of each ingredient of the fragrance and takes into account the number and types of atoms, the atomic bond capability and the chemical bond. The Clog P values, which are the most reliable and most widely used predicted values for this physical chemical characteristic, are used in the context of this invention in preference to the experimental log P values when selecting the ingredients of the fragrance that are useful in the present invention.

The boiling points of a large number of odoriferous substances are published by S. Arctander, in "Perfume and Flavor Chemicals (Aroma Chemicals)", published in 1969, incorporated herein by reference. Other boiling point values can be found for example in various known chemical handbooks and databanks, such as the Beilstein Handbook, Lange's Handbook of Chemistry, and the CRC Handbook of Chemistry and Physics. If a boiling point is only listed at a different pressure, generally at a lower pressure than the normal pressure of 760 mm Hg, then the boiling point at normal pressure can be estimated with the help of the boiling point-pressure nomographs such as those listed in "The Chemist's Companion", A. J. Gordon und R. A. Ford, John Wiley & Sons Publishers, 1972, pp. 30-36. Where applicable, the boiling point values can also be calculated with a computer program based on the molecular structure data such as those described in "Computer-assisted Prediction of Normal Boiling Points of Pyrans and Pyrroles", D. T. Starton et al., J. Chem. Inf. Comput. Sci., 32 (1992), pp. 306-316, "Computer-assisted Prediction of Normal Boiling Points of Furans, Tetrahydrofurans, and Thiophenes", D. T. Starton et al., J. Chem. Inf. Comput. Sci., 31 (1992), pp. 301-310, and the references cited therein, and "Predicting Physical Properties from Molecular Structure", R. Murugan et al., Chemtech. June 1994, p. 17-23. All the publications cited above are incorporated by reference.

In Table 1 below, several odoriferous substances are listed that fulfil the criteria boiling point>250° C. and Clog P≥3. Those odoriferous substances that satisfy these criteria are referred to hereinafter as persistent odoriferous substances.

TABLE 1

Examples of persistent odoriferous substances

| Fragrance constituents | Approximate boiling pt (° C.) | Clog P |
|---|---|---|
| Boiling point > 250° C. and Clog P ≥ 3.0 | | |
| Allylcylclohexane propionate | 267 | 3.935 |
| Ambrettolide | 300 | 6.261 |
| Amyl benzoate | 262 | 3.417 |
| Amyl cinnamate | 310 | 3.771 |
| Amylcinnamaldehyde | 285 | 4.324 |
| Amylcinnamaldehyde dimethyl acetal | 300 | 4.033 |
| iso-Amyl salicylate | 277 | 4.601 |
| Aurantiol | 450 | 4.216 |
| Benzophenone | 306 | 3.120 |
| Benzyl salicylate | 300 | 4.383 |
| para-tert-Butylcyclohexyl acetate | +250 | 4.019 |
| iso-Butylquinoline | 252 | 4.193 |
| beta-Caryophyllene | 256 | 6.333 |
| Cardinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro-iso-jasmonate | +300 | 3.009 |
| Diphenylmethane | 262 | 4.059 |
| Diphenyl oxide | 252 | 4.240 |
| Dodecalactone | 258 | 4.359 |
| iso E super | +250 | 3.455 |
| Ethyl brassylate | 3321 | 4.554 |
| Ethylmethylphenyl glycidate | 260 | 3.165 |
| Ethyl undecylenate | 264 | 4.888 |
| Exaltolide | 280 | 5.346 |
| Galaxolide | +250 | 5.482 |
| Geranyl anthranilate | 312 | 4.216 |
| Geranyl phenylacetate | +250 | 5.233 |
| Hexadecanolide | 294 | 6.805 |
| Hexenyl salicylate | 271 | 4.716 |
| Hexylcinnamaldehyde | 305 | 5.473 |
| Hexyl salicylate | 290 | 5.260 |
| alpha-Iron | 250 | 3.820 |
| Lilial (p-t-bucinal) | 258 | 3.858 |
| Linalyl benzoate | 263 | 5.233 |
| 2-Methoxynaphthalene | 274 | 3.235 |
| Methyl dihydrojasmone | +300 | 4.843 |
| gamma-n-Methylionene | 252 | 4.309 |
| Musk indanone | +250 | 5.458 |
| Musk ketone | mpt. = 137° C. | 3.014 |
| Musk tibetine | mpt. = 136° C. | 3.831 |
| Myristicine | 276 | 3.200 |
| Oxahexadecanolide-10 | +300 | 4.336 |
| Oxahexadecanolide-11 | mpt. = 35° C. | 4.336 |
| Patchouli alcohol | 285 | 4.530 |
| Phantolide | 288 | 5.977 |
| Phenylethyl benzoate | 300 | 4.058 |
| Phenylethylphenyl acetate | 325 | 3.767 |
| Phenylheptanol | 261 | 3.478 |
| Phenylhexanol | 258 | 3.299 |
| alpha-Santalol | 301 | 3.800 |
| Thibetolid | 280 | 6.246 |
| delta-Undecalactone | 290 | 3.830 |
| gamma-Undecalactone | 297 | 4.140 |
| Vetiveryl acetate | 285 | 4.882 |
| Yara-yara | 274 | 3.235 |

(a) mpt. is the melting point; these constituents have a boiling point higher than 250° C.

This Table shows a sufficient number of non-limitative examples of persistent odoriferous substances that can be employed in the scope of the present invention. The shaped articles of the present invention preferably comprise at least 3 different persistent odoriferous substances, more preferably at least 4 different persistent odoriferous substances, and even more preferably at least 5 different persistent odoriferous substances.

According to a preferred embodiment of the invention, the shaped articles preferably comprise ≥20 wt. %, ≥25 wt. %, ≥30 wt. %, ≥35 wt. %, ≥40 wt. %, ≥45 wt. %, ≥50 wt. %, ≥55 wt. %, ≥60 wt. %, ≥65 wt. %, ≥75 wt. %, ≥80 wt. %, ≥85 wt. %, ≥90 wt. % or even ≥95 wt. % of persistent odoriferous substances, wt. % based on the total quantity of the odoriferous substances comprised in the shaped article.

In the field of perfumery, some odorless materials or those with a very weak odor are used as diluents or extenders for the perfume. Non-limiting examples of these materials are dipropylene glycol, diethyl phthalate, triethyl citrate, isopropyl myristate and benzyl benzoate. These materials are used e.g. for diluting and stabilizing several other fragrance constituents. These materials are not taken into account in calculating the total quantity of the odoriferous substances in the shaped articles.

Non-persistent odoriferous substances in the context of this invention are those odoriferous substances that have a boiling point lower than about 250° C. or a Clog P of less than 3.0 or both a boiling point lower than about 250° C. and a Clog P of less than 3.0. According to a preferred embodiment, the shaped articles of the present invention preferably comprise minimal quantities of non-persistent odoriferous substances, i.e. the shaped articles preferably comprise ≤60 wt. %, ≤55 wt. %, ≤50 wt. %, ≤45 wt %, ≤40 wt. %, ≤35 wt. %, ≤30 wt. %, ≤25 wt. %, ≤20 wt. %, ≤15 wt. %, ≤10 wt. %, ≤5 wt. %, ≥3 wt. %, ≥2 wt. % or even ≥1 wt. % of non-persistent odoriferous substances, wt. % based on the total quantity of the odoriferous substances comprised in the shaped article.

However, it can be advantageous if non-persistent odoriferous substances are used in at least small quantities, namely for improving the smell of the shaped article as such. Accordingly, the shaped articles of the present invention preferably comprise ≥1 wt. %, preferably ≥5 wt. %, more preferably ≥15 wt. %, especially even ≥20 wt. %, ≥25 wt. %, or even ≥30 wt. %, of non-persistent odoriferous substances, wt. % based on the total quantity of the odoriferous substances comprised in the shaped article.

When the perfume comprised in the shaped articles according to the invention exists in at least 1, 2, 5, 10, 15, 20 or 25 wt. % in encapsulated form, then this is a preferred embodiment. The fraction of the comprised perfume in encapsulated form can also be even greater, e.g. at values of at least 30, 35, 40 or 45 wt. %. Here, wt. % refers to the total weight of the perfume comprised in the shaped article.

Preferably, the encapsulated perfume particles can be activated by moisture. Perfume particles of this type are known. For example they can be cyclodextrin/perfume inclusion complexes or perfume microcapsules, e.g. with a polysaccharide binder. The encapsulation of the perfume minimizes even further a premature volatilization of the odoriferous substances. The encapsulated perfume is only released then when the materials are moistened.

The diameter of the perfume capsules can be for example from 100 nm to e.g. 1 mm. It is also possible to use perfume capsules with a diameter above 1 mm. Preferred perfume microcapsules have a diameter of e.g. 0.5 μm to 300 μm, preferably 1 μm to 200 μm, especially 2 μm to 100 μm. The capsule diameter is naturally matched to the film thickness. The maximum diameter of the capsules can also be e.g. at values of <90 μm, <80 μm, <70 μm, <60 μm, <50 μm or <40 μm.

Particularly useful encapsulation methods include coacervation, liposome formation, granulation, coating, emulsification, atomization and spray cooling.

According to the present invention, the capsules can be incorporated into a preferably water-soluble film. The capsules are preferably immiscible with the film. The capsules are advantageously hydrophobic in nature so as to prevent their diffusion into the hydrophilic film. For example, the capsules can preferably be manufactured in situ as a part of the film casting process.

The preferably hydrophobic constituent for the capsules is especially selected from the group consisting of paraffin, wax, oil, Vaseline, a hydrophobic polymer and mixtures thereof.

In the in situ manufacture, the e.g. hydrophobic continuous phase is melted and can then be blended with either an oil-soluble beneficial agent (such as e.g. perfume) or a discontinuous phase or with both. The resulting solution or emulsion or dispersion is blended with a solution of a water-soluble film in water (for example with a ratio of film to water of 1:4). The mixture is preferably manufactured at a relatively low temperature so as to protect sensitive constituents of the beneficial agent, when present (for example 30-45° C.). The result is an emulsion in the water-soluble film. The emulsion is cast and e.g. sintered in an oven to form a film with capsules.

According to another embodiment, the shaped article according to the invention does not comprise any capsules or microcapsules or perfume in encapsulated form.

According to a preferred embodiment, the shaped article according to the invention comprises precursors of odoriferous substances that in the presence of water preferably release odoriferous substances by hydrolysis. The precursors of odoriferous substances can be advantageously selected from β-aminoketone precursors of odoriferous substances, aldehyde or ketone releasing precursors of odoriferous substances, alcohol releasing precursors of odoriferous substances, preferably esters of silicic acid as well as ortho carbonate and ortho ester precursors of odoriferous substances.

The precursors of odoriferous substances are advantageously selected from acetals, ketals, ortho esters, ortho carbonates and mixtures thereof.

A particularly preferred precursor of odoriferous substances satisfies the Formula

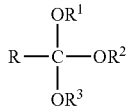

in which R means hydrogen, linear $C_1$-$C_8$ alkyl, branched $C_3$-$C_{20}$ alkyl, cyclic $C_3$-$C_{20}$ alkyl, branched cyclic $C_6$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl and mixtures thereof; $R^1$, $R^2$ and $R^3$ stand independently of one another for linear, branched or substituted $C_1$-$C_{20}$ alkyl, linear, branched or substituted $C_2$-$C_{20}$ alkenyl, substituted or unsubstituted, cyclic $C_3$-$C_{20}$ alkyl, substituted or unsubstituted $C_6$-$C_{20}$ aryl, substituted or unsubstituted $C_2$-$C_{40}$ alkylene oxy, substituted or unsubstituted $C_3$-$C_{40}$ alkylene oxyalkyl, substituted or unsubstituted $C_6$-$C_{40}$ alkylene aryl, substituted or unsubstituted $C_6$-$C_{32}$ aryl oxy, substituted or unsubstituted $C_6$-$C_{40}$ alkylene oxy aryl, $C_6$-$C_{40}$ oxy alkylene aryl and mixtures thereof.

According to a preferred embodiment, the comprised precursor of odoriferous substances is an acetal or a ketal of the Formula

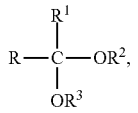

in which R is a, linear $C_1$-$C_{20}$ alkyl, branched $C_3$-$C_{20}$ alkyl, cyclic $C_6$-$C_{20}$ alkyl, branched cyclic $C_6$-$C_{20}$ alkyl, linear $C_6$-$C_{20}$ alkenyl, branched $C_3$-$C_{20}$ alkenyl, cyclic $C_6$-$C_{20}$ alkenyl, branched cyclic $C_6$-$C_{20}$ alkenyl, substituted or unsubstituted $C_6$-$C_{20}$ aryl and mixtures thereof; $R^1$ is hydrogen or R, $R^2$ and $R^3$ are independently of one another selected from the group consisting of $C_1$-$C_{20}$ alkyl, branched $C_3$-$C_{20}$ alkyl, cyclic $C_3$-$C_{20}$ alkyl, branched cyclic $C_3$-$C_{20}$ alkyl, linear $C_6$-$C_{20}$ alkenyl, branched $C_6$-$C_{20}$ alkenyl, cyclic $C_6$-$C_{20}$ alkenyl, branched cyclic $C_6$-$C_{20}$ alkenyl, $C_6$-$C_{20}$ aryl, substituted $C_7$-$C_{20}$ aryl and mixtures thereof.

According to a preferred embodiment, the comprised precursor of odoriferous substances has the following Formula:

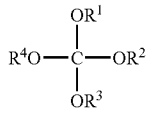

in which $R^1$, $R^2$, $R^3$ and $R^4$ independently of one another are linear, branched or substituted $C_1$-$C_{20}$ alkyl, linear, branched or substituted $C_2$-$C_{20}$ alkenyl, substituted or unsubstituted, cyclic $C_5$-$C_{20}$ alkyl, substituted or unsubstituted $C_6$-$C_{20}$ aryl, substituted or unsubstituted $C_2$-$C_{40}$ alkylene oxy, substituted or unsubstituted $C_3$-$C_{40}$ alkylene oxy alkyl, substituted or unsubstituted $C_6$-$C_{40}$ alkylene aryl, substituted or unsubstituted $C_6$-$C_{32}$ aryl oxy, substituted or unsubstituted $C_6$-$C_{40}$ alkylene oxy aryl, $C_6$-$C_{40}$ oxyalkylene aryl and mixtures thereof.

The addition of appropriate precursors of odoriferous substances affords shaped articles having excellent fragrant properties in aqueous systems, in particular in regard to the length and permanence of the fragrant impression, also on treated substrates, such as textiles in particular. Above all, the combination of precursors of odoriferous substances with the above described persistent odoriferous substances and/or cationic polymers affords films having excellent fragrant properties.

A shaped article according to the invention can preferably contain odoriferous substances selected from the group bergamot oil, tangerine oil, dimethyl anthranilate, dihydromyrcenol (2-methyl-6-methylene-2-octanol), tetrahydrolinalool, isobornyl acetate, ethyl linalool, limonene, orange oil, isobornyl acetate, eucalyptus oil (Globulus), aldehyde C 10, styryl acetate, citronitrile ((Z,E)-3-methyl-5-phenyl-2-pentene nitrile), undecavertol (4-methyl-3-decen-5-ol), styryl acetate, Tonalid (acetyl hexamethyl tetralin). These odoriferous substances can inspire a particularly good impression of freshness, both in regard to the shaped article itself as well as to its use in aqueous systems.

A shaped article according to the invention can preferably include odoriferous substances selected from the group Aldehyde C 14, Decalactone gamma, Cyclamen aldehyde, Troenan (5-methyl-5-propyl-2-(1-methylbutyl)-1,3-dioxane), canthoxal (2-methyl-3-(para-methoxyphenyl) propanal), citronellol, geraniol, musk, phenylethyl alcohol, Phenirat (2-phenylethyl 2-methylpropanoate), phenylethyl isobutyrate, Jasmelia (2H-pyran-4-ol, 3-butyltetrahydro-5-methyl acetate), hexylcinnamaldehyde (alpha), Ylang, cyclohexyl salicylate, hexenyl salicylate (cis-3), Sandelice, Guajak wood oil, Iso E Super (7-acetyl, 1,2,3,4,5,6,7,8-octahydro-1,1,6,7-tetramethyl naphthalene), Norlimbanol, Ambroxan (3aR-(3a-alpha,5a-beta,9a-alpha,9b-beta))-dodecahydro-3a,6,6,9a-tetramethyl naphtho(2,1-b)furan), cinnamyl alcohol, cyclopentadecanolide, Nirvanol ((S)-(+)-5-ethyl-5-phenylhydantoin), Javanol (1-methyl-2-((1,2,2-trimethylbicyclo(3.1.0)hex-3-yl)methyl)cyclopropane methanol), Habanolide (oxacyclohexadecen-2-one), Maltol, benzylacetone, coumarin, benzyl salicylate, Melonal (2,6-dimethyl-5-heptenal), Galbanum (oil), ethyl vanillin, Coavone (3-hepten-2-one, 3,4,5,6,6-pentamethyl), methyl palmitate, methyl oleate and/or methyl myristate. These odoriferous substances can inspire a particularly good impression of maintenance, both in regard to the shaped article itself as well as to its use in aqueous systems.

According to a preferred embodiment, the shaped article according to the invention is essentially free of constituents other than perfume and polymeric material. Consequently, a shaped article according to the invention preferably consists of ≥65 wt. %, ≥70 wt. %, ≥75 wt. %, ≥80 wt. %, ≥85 wt. %, ≥90 wt. %, ≥95 wt. % or even ≥98 wt. % of the constituents polymer and perfume.

Other possible constituents that can be comprised in the shaped articles according to the invention are advantageously selected from the group of the surfactants, builders, bleaching agents, bleach activators, enzymes, electrolytes, non-aqueous solvents, pH adjustors, fluorescent agents, dyes, skin care agents, hydrotropes, fiber finishers, foam inhibitors, silicone oils, anti-redeposition agents, optical brighteners, graying inhibitors, laddering retardants, anti-crease agents, color transfer inhibitors, antimicrobials, germicides, fungicides, antioxidants, corrosion inhibitors, antistats, ironing aids, water-repellents and impregnation agents, swelling and non-skid agents and UV-absorbers.

Advantageous surfactants, in so far as they are comprised at all, are especially cationic, anionic, non-ionic and/or amphoteric surfactants, comprised in amounts of e.g. 0.1 wt. % up to ≤20 wt. %, preferably ≤15 wt. %, ≤10 wt. %, ≤9 wt. %, ≤8 wt. %, ≤7 wt. %, ≤6 wt. %, ≤5 wt. %, ≤4 wt. %, ≤3 wt. % or ≤2 wt. %, especially ≤1 wt. %, wt. % based on the total shaped article. In particular, a shaped article according to the invention does not comprise any surfactant.

Bleaching agents are advantageous, such as preferably bleaching agents based on oxygen, such as e.g. sodium perborate. Sodium percarbonate, $H_2O_2$, bleaching agents based on chlorine, such as sodium hypochlorite, peroxycarboxylic acid, such as e.g. PAP (N,N-phthalimido perhexanoic acid) and/or bleach activators, such as TAED (N,N,N',N'-tetraacetylethylenediamine), NOBS (sodium p-nonanoyloxybenzene sulfonate), in so far as they are comprised at all, are comprised in amounts of e.g. 0.1 wt. % up to ≤20 wt. %, preferably ≤15 wt. %, ≤10 wt. %, ≤9 wt. %, ≤8 wt. %, ≤7 wt. %, ≤6 wt. %, ≤5 wt. %, ≤4 wt. %≤3 wt. % or ≤2 wt. %, especially ≤1 wt. %, wt. % based on the total shaped articles. In particular, a shaped article according to the invention comprises neither bleaching agent nor bleach activator.

Advantageous builders, such as e.g. zeolites, soda (sodium carbonate), polycarboxylates, alkaline amorphous disilicates, crystalline layered silicates, citrates or citric acid, in so far as they are comprised at all, are comprised in amounts of e.g. 0.1 wt. % up to ≤20 wt. %, preferably ≤15 wt. %, ≤10 wt.

%, ≤9 wt. %, ≤8 wt. %, ≤7 wt. %, ≤6 wt. %, ≤5 wt. %, ≤4 wt. %, ≤3 wt. % or ≤2 wt. %, especially ≤1 wt. %, wt. % based on the total shaped article. In particular, a shaped article according to the invention does not comprise any builder.

Advantageous fiber finishers, such as e.g. fatty acid derivatives, silicone oils, layered silicates such as bentonite and/or cationic surfactants, preferably quaternary ammonium compounds, especially esterquats, in so far as they are comprised at all, are comprised in amounts of e.g. 0.1 wt. % up to ≤30 wt. %, preferably ≤20 wt. %, ≤15 wt. %, ≤10 wt. %, ≤9 wt. %, ≤8 wt. %, ≤7 wt. %, ≤6 wt. %, ≤5 wt. %, ≤4 wt. %, ≤3 wt. % or ≤2 wt. %, especially ≤1 wt. %, wt. % based on the total shaped article. In particular, a shaped article according to the invention does not comprise any fiber finisher.

The term esterquat stands for a collective name for cationic surface active compounds containing preferably two hydrophobic groups which are linked through ester bonds with a quaternized di(tri)ethanolamine or with an analogous compound. In particular, the addition of esterquats in combination with the above cited persistent odoriferous substances and/or with the cationic polymer and/or encapsulated perfume yields very good fragrant results for the shaped article as such as well as for the resulting aqueous system as for substrates that are treated in/with the aqueous perfumed system.

Advantageous skin care agents, in so far as they are comprised at all, are comprised in amounts of e.g. 0.1 wt. % up to ≤30 wt. %, preferably ≤20 wt. %, ≤15 wt. %, ≤10 wt. %, ≤9 wt. %, ≤8 wt. %, ≤7 wt. %, ≤6 wt. %, ≤5 wt. %, ≤4 wt. %, ≤3 wt. % or ≤2 wt. %, especially ≤1 wt. %, wt. % based on the total shaped article. In particular, a shaped article according to the invention does not comprise any skin-care agent. Skin care agents can be for example those agents that can lend a sensorial advantage to the skin, e.g. by providing lipids and/or moisturizing factors. Skin care agents can be e.g. proteins, amino acids, lecithins, lipoids, phosphatides, plant extracts, vitamins; likewise, fatty alcohols, fatty acids, fatty acid esters, waxes, Vaseline, paraffins can also act as skin care agents.

In a preferred embodiment, the inventive products comprise both skin care agents as well as fiber finishers, such as e.g. quaternary ammonium compounds, preferably esterquats.

In particular, the skin care agents can also contain antiseptically active substances such as e.g. ethereal oil. In particular, the skin care agents can also contain skin-protecting oil, e.g. almond oil.

Enzymes, electrolytes, non-aqueous solvents, pH adjustors, fluorescent agents, dyes, hydrotropes, foam inhibitors, silicone oils, anti-redeposition agents, optical brighteners, graying inhibitors, laddering retardants, anti-crease agents, color transfer inhibitors, antimicrobials, germicides, fungicides, antioxidants, corrosion inhibitors, antistats, ironing aids, water-repellents and impregnation agents, swelling and non-skid agents and/or UV-absorbers are preferably comprised, in so far as they are comprised at all, in amounts, preferably each ≤20 wt. %, ≤15 wt. %≤10 wt. %, ≤9 wt. %, ≤8 wt. %, ≤7 wt. %, ≤6 wt. %, ≤5 wt. %, ≤4 wt. %, ≤3 wt. % or ≤2 wt. % especially ≤1 wt. %, wt. % based on the total shaped article. In particular, a shaped article according to the invention can be free of each individual substance, thus e.g. free of enzymes, and/or free of electrolytes etc.

A further subject matter of this application is a method for perfuming or reinforcing the fragrance of an aqueous system, preferably a laundry liquor, cleaning liquor or rinsing liquor, wherein at least a portion of the perfumed, preferably water-soluble or water-dispersible shaped article is taken out of the inventive fragrant medium dispensing system and added to the aqueous system, especially to the laundry liquor. When the fragrancing is in the context of an automatic textile wash, the shaped article according to the invention can be placed directly into the drum of the washing machine or even into the laundry detergent draw.

A further subject matter of this application is a method for depositing fragrances onto textiles in a washing machine by adding an inventive shaped article taken out of the fragrant medium dispensing system according to the invention, wherein the shaped articles are added to the wet laundry in the wash cycle or rinse cycle of an automatic washing process.

A further subject matter of this application is a method for depositing fragrances onto textiles in an automatic laundry dryer by adding an inventive shaped article taken out of the fragrant medium dispensing system according to the invention, wherein the shaped articles are added into the dryer to the moist laundry to be dried.

A further subject matter of the present invention is the use of a fragrant medium dispensing system according to the invention for the individual dosing of fragrances.

A further subject matter of the present invention is the use of a shaped article taken out of the fragrant medium dispensing system according to the invention for fragrancing or reinforcing the fragrance of an aqueous system, advantageously a laundry liquor for textiles, dishwasher liquor, bath water or a cleaning liquid for cleaning hard surfaces, such as preferably floors or windows. Likewise, the fragrancing of a porcelain WC-standard bowl (so called sit-down toilet) is possible. For this the shaped article is placed in the siphon water, where a pleasant odor is then evolved, for example in order to mask the already present unpleasant odors.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient.

Although specific terms have been employed herein, such terms are intended in a descriptive sense and not for purposes of limitation.

It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

What is claimed:

1. A dispensing system for a perfumed shaped article, comprising a withdrawal receptacle and a perfumed shaped article supplied in the withdrawal receptacle, said article being in the form of a foamed film comprising at least 30 wt. % and no more than 60 wt. % of a water-soluble polymer and at least 10 wt. % of a perfume, wherein the polymer and at least a portion of the perfume are homogenously blended within the film material, wherein said article comprises 6 wt. % to 20 wt. % surfactant, and wherein the water-soluble polymer comprises: (1) one or more polymers selected from the group consisting of polyvinyl alcohol, polyvinyl pyrrolidone, polyalkyene oxide, polyalkylene glycol, and copolymers thereof; and (2) 6 wt. % to 30 wt. % of a cationic polymer by weight of the perfumed shape article.

2. The system of claim 1, wherein the perfumed shaped article is strip-shaped, sheet-shaped, disk-shaped, or web-shaped.

3. The system of claim 2, wherein the perfumed shaped article is flexible.

4. The system of claim 1, wherein the withdrawal receptacle comprises a flexible or inflexible, optionally reclosable receptacle that surrounds the shaped article.

5. The system of claim 4, wherein the withdrawal receptacle comprises a box having a storage reservoir and a dosing device.

6. The system of claim 3, comprising a roll on which a plurality of the strip-shaped, sheet-shaped, disk-shaped, or web-shaped, flexible shaped articles are wound.

7. The system of claim 6, wherein the roll has separation points that permit withdrawal of a single flexible shaped article.

8. The system of claim 1, wherein the shaped article comprises at least 12 wt. % perfume.

9. The system of claim 8, wherein the shaped article comprises at least 15 wt. % perfume.

10. The system of claim 9, wherein the shaped article comprises at least 20 wt. % perfume.

11. The system of claim 1, wherein the perfume comprises at least 5 wt. % of odoriferous substances having a boiling point above 250° C. and a Clog P value of ≥3.0.

12. The system of claim 1, wherein at least 5 wt. % of the perfume in the shaped article is present in encapsulated form.

13. The system of claim 1, wherein the shaped article comprises a precursor of an odoriferous substance that releases the odoriferous substance in the presence of water.

14. The system of claim 1, wherein the shaped article comprises a foamed film.

15. A method of perfuming or reinforcing the fragrance of an aqueous system, comprising adding to the aqueous system at least a portion of a shaped perfumed article dispensed from the system of claim 1.

16. The method of claim 15, wherein the aqueous system is a laundry liquor.

17. The method of claim 15, wherein the aqueous system is a dishwasher liquor.

18. The method of claim 15, wherein the aqueous system is a bath water.

19. The method of claim 15, wherein the aqueous system is a cleaning liquid for a hard surface.

20. The system of claim 1, wherein the polymer includes no more than 10 wt. % of the cationic polymer by weight of the perfumed shape article.

21. The system of claim 1, wherein the surfactant is an anionic surfactant.

22. The system of claim 1, wherein the article further comprises a silicic acid.

* * * * *